US010190834B2

(12) United States Patent
Smith et al.

(10) Patent No.: US 10,190,834 B2
(45) Date of Patent: Jan. 29, 2019

(54) CHARGING HANDLE

(71) Applicant: Vista Outdoor Operations LLC, Farmington, UT (US)

(72) Inventors: Paul N. Smith, Bozeman, MT (US); Aden P. Wright, Chico, CA (US); Bryan P. Peterson, Isanti, MN (US); Christopher D. Laack, Kansas City, MO (US); Robert J. Meinert, Andover, MN (US)

(73) Assignee: Vista Outdoor Operations LLC, Farmington, UT (US)

( * ) Notice: Subject to any disclaimer, the term of this patent is extended or adjusted under 35 U.S.C. 154(b) by 0 days.

(21) Appl. No.: 15/702,168

(22) Filed: Sep. 12, 2017

(65) Prior Publication Data

US 2018/0080726 A1 Mar. 22, 2018

Related U.S. Application Data

(60) Provisional application No. 62/393,458, filed on Sep. 12, 2016.

(51) Int. Cl.
*F41A 3/72* (2006.01)
*F41A 35/06* (2006.01)

(52) U.S. Cl.
CPC ..... *F41A 3/72* (2013.01); *F41A 35/06* (2013.01)

(58) Field of Classification Search
CPC ..... F41A 3/72; F41A 35/06; F41A 7/02
USPC ..... 89/1.4
See application file for complete search history.

(56) References Cited

U.S. PATENT DOCUMENTS

| | | | | |
|---|---|---|---|---|
| 3,225,653 | A | 12/1965 | Packard | |
| 5,758,524 | A | 6/1998 | Yu | |
| 6,311,603 | B1 | 11/2001 | Dunlap | |
| 7,231,861 | B1 | 6/2007 | Gauny et al. | |
| 7,240,600 | B1 | 7/2007 | Bordson | |
| 7,588,023 | B2 | 9/2009 | Kung et al. | |
| D614,718 | S * | 4/2010 | Hoel | D22/108 |
| 7,707,921 | B1 * | 5/2010 | Hoel | F41A 35/06 42/16 |
| 7,798,045 | B1 | 9/2010 | Fitzpatrick et al. | |
| 7,832,322 | B1 * | 11/2010 | Hoel | F41A 35/06 42/16 |
| 7,861,635 | B1 | 1/2011 | Hoel | |
| 7,900,546 | B2 | 3/2011 | Bordson | |
| 8,104,393 | B2 | 1/2012 | Kincel | |
| 8,261,649 | B2 | 9/2012 | Fitzpatrick et al. | |
| 8,336,436 | B2 | 12/2012 | Kincel | |
| 8,356,537 | B2 | 1/2013 | Kincel | |

(Continued)

*Primary Examiner* — Michelle Clement
(74) *Attorney, Agent, or Firm* — Christensen, Fonder, Dardi & Herbert PLLC

(57) ABSTRACT

An example charging handle comprises a body having a handle portion, a bolt engaging portion and a shaft portion extending forwardly from the handle portion to the bolt engaging portion. The handle portion of the body may have a starboard arm extending away from the shaft portion in a starboard direction and a port arm extending away from the shaft portion in a portward direction. The charging handle may comprise a grip member disposed about the handle portion of the body so that the grip member encapsulates the handle portion and the handle portion is disposed inside the grip member. The grip member may comprise a thermoplastic material overmolded on the handle portion of the body.

9 Claims, 28 Drawing Sheets

(56) References Cited

U.S. PATENT DOCUMENTS 8,381,628 B1 2/2013 Wheatley
8,567,301 B1 * 10/2013 Sharron ..... F41A 35/06 89/1.4
D694,354 S 11/2013 Underwood
D701,280 S 3/2014 Siddle et al.
D705,383 S 5/2014 Montes
D705,384 S 5/2014 Underwood
8,756,847 B2 6/2014 Huther
8,800,422 B2 8/2014 Norton et al.
D712,501 S 9/2014 Weltsch
8,820,210 B2 9/2014 Melville
8,863,632 B1 * 10/2014 O'Malley ..... F41A 3/72 42/16
8,887,612 B2 11/2014 Bayly
8,950,097 B2 2/2015 Sugg et al.
8,960,066 B2 * 2/2015 Gomez ..... F41A 3/72 89/1.4
D724,689 S 3/2015 Sui
D726,860 S 4/2015 Underwood
D738,452 S 9/2015 Underwood
9,175,913 B2 11/2015 Cupps et al.
9,222,738 B2 12/2015 Asher et al.
D749,687 S 2/2016 Warensford
9,366,489 B1 6/2016 Strom
9,377,258 B2 6/2016 Gomez
D761,374 S 7/2016 Ellsworth
9,423,195 B2 8/2016 Daley, Jr. et al.
9,435,593 B2 9/2016 McGinty
D772,369 S 11/2016 Geissele
9,482,479 B1 * 11/2016 Jen ..... F41A 3/72
9,488,424 B1 * 11/2016 Kincel ..... F41A 3/72
D776,223 S 1/2017 Swift et al.
D781,986 S 3/2017 Green et al.
D781,988 S 3/2017 Geissele
9,587,896 B1 * 3/2017 Huang ..... F41A 35/06
D787,624 S 5/2017 Novak et al.
D787,625 S 5/2017 Parker et al.
D788,251 S 5/2017 Sylvester et al.
D794,741 S 8/2017 Geissele
9,726,445 B2 8/2017 Gomez
9,733,030 B2 * 8/2017 Daniel ..... F41A 3/72
9,746,263 B2 * 8/2017 Hillman ..... G01N 15/06
D796,620 S 9/2017 Geissele
D798,409 S 9/2017 Kincel et al.
9,810,494 B1 11/2017 Huang
D805,598 S 12/2017 Geissele
9,846,003 B2 * 12/2017 Hwang ..... F41A 35/06
9,909,826 B2 3/2018 Kincel
9,964,371 B1 * 5/2018 Huang ..... F41A 3/72
9,976,823 B1 * 5/2018 Pike ..... F41A 3/72
10,006,728 B2 * 6/2018 Bailey ..... F41A 3/72
10,012,461 B2 * 7/2018 Curry ..... F41A 3/72
D825,020 S * 8/2018 Smith ..... D22/108
2005/0188827 A1 9/2005 McNulty, Jr.
2009/0064556 A1 * 3/2009 Fluhr ..... F41A 3/72 42/14
2009/0241396 A1 10/2009 McManus
2010/0000396 A1 * 1/2010 Brown ..... F41A 3/72 89/1.4
2011/0005117 A1 1/2011 Bordson
2011/0174139 A1 7/2011 Olsen et al.
2011/0214558 A1 9/2011 Kincel
2011/0226120 A1 * 9/2011 Fitzpatrick ..... F41A 19/47 89/1.4
2011/0265636 A1 * 11/2011 Overstreet ..... F41A 3/72 89/1.4
2012/0006188 A1 1/2012 Kincel
2012/0042769 A1 2/2012 Makayama et al.
2012/0291612 A1 11/2012 Kincel
2012/0318124 A1 12/2012 Brown
2013/0061737 A1 3/2013 Brown
2013/0092014 A1 * 4/2013 Kincel ..... F41A 3/72 89/1.4
2013/0174457 A1 7/2013 Gangl et al.
2013/0192113 A1 * 8/2013 Melville ..... F41A 3/72 89/1.4
2013/0228065 A1 9/2013 Fitzpatrick et al.
2014/0020549 A1 * 1/2014 Bayly ..... F41A 3/72 89/1.4
2014/0060293 A1 * 3/2014 Gomez ..... F41A 3/72 89/1.4
2014/0060294 A1 3/2014 Brown
2014/0068988 A1 * 3/2014 Donahue ..... F41A 3/72 42/69.01
2014/0150639 A1 6/2014 Sugg et al.
2014/0224103 A1 8/2014 Brown
2014/0318356 A1 * 10/2014 Cupps ..... F41A 3/72 89/1.4
2014/0345444 A1 * 11/2014 Hillman ..... G01N 15/06 89/1.4
2014/0352191 A1 * 12/2014 Fritz ..... F41A 5/18 42/75.03
2015/0053072 A1 * 2/2015 Bunker ..... F41A 3/72 89/1.4
2015/0192376 A1 * 7/2015 Dickinson ..... F41A 3/72 89/1.4
2015/0233657 A1 8/2015 Barker et al.
2015/0253105 A1 9/2015 Brubaker et al.
2015/0260481 A1 9/2015 Sugg et al.
2015/0276335 A1 * 10/2015 Daley, Jr. ..... F41A 3/66 42/75.01
2015/0308760 A1 10/2015 Gomez
2015/0308761 A1 10/2015 McGinty
2015/0308762 A1 10/2015 McGinty
2016/0018181 A1 1/2016 Swadener et al.
2016/0061542 A1 3/2016 Daley, Jr. et al.
2016/0076834 A1 3/2016 McGinty
2016/0102930 A1 * 4/2016 Miller ..... F41A 3/72 89/1.4
2016/0153731 A1 6/2016 Sugg
2016/0178298 A1 * 6/2016 Daniel ..... F41A 3/72 89/1.4
2016/0258698 A1 * 9/2016 Seuk ..... F41A 35/06
2016/0282070 A1 * 9/2016 Orne, III ..... F41A 3/72
2016/0298917 A1 10/2016 Hwang
2016/0320151 A1 * 11/2016 Kincel ..... F41A 3/72
2016/0348989 A1 12/2016 Strom
2016/0356564 A1 * 12/2016 Curry ..... F41A 3/72
2017/0023321 A1 * 1/2017 Kincel ..... F41A 3/72
2017/0038170 A1 2/2017 Gomez
2018/0010868 A1 * 1/2018 Bailey ..... F41A 3/72

* cited by examiner

CHARGING HANDLE

CROSS-REFERENCE TO RELATED APPLICATION

This application claims priority to U.S. Provisional application 62/393,458 filed on Sep. 12, 2016, the contents of which is incorporated by reference herein in its' entirety.

BACKGROUND OF THE DISCLOSURE

In recent years, the modern sporting rifle (MSR) has become a popular firearm for use in hunting and target practice. The MSR is based on the AR-15 platform designed by Eugene Stoner while working as an engineer at the Armalite Company. The MSR may sometimes appear cosmetically similar to military rifles, such as the M-16. However, the MSR functions like other semi-automatic civilian sporting rifles, firing only one round with each pull of the trigger. The MSR is commercially available from several manufacturers. Each manufacturer may offer several MSR models in popular configurations.

Modern sporting rifles are gas operated rifles utilizing a direct gas impingement system for operating their ejection and loading mechanisms. The expanding gas from the cartridge propellant is tapped from a port in the barrel intermediate the chamber and the muzzle end of the barrel. In the direct gas impingement system, a conduit extends from the port to the upper receiver and into the region of the bolt carrier. During the initial firing of the cartridge, the bolt is locked into the barrel extension, the gas forces the bolt carrier backward a short distance to unlock the bolt. As the bolt carrier moves toward the butt of the gun, a bolt cam pin, forces the bolt to rotate, by this time the bullet has left the barrel. The inertia of the bolt and bolt carrier continues the rearward motion causing the bolt to extract the fired empty cartridge. A spring absorbs the rearward motion of the bolt and bolt carrier forcing the bolt and bolt carrier forward to engage the next cartridge in the magazine and push same into the chamber ready for firing.

SUMMARY

An example charging handle comprises a body having a handle portion, a bolt engaging portion and a shaft portion extending forwardly from the handle portion to the bolt engaging portion. The handle portion of the body may have a starboard arm extending away from the shaft portion in a starboard direction and a port arm extending away from the shaft portion in a portward direction. The charging handle may comprise a grip member disposed about the handle portion of the body so that the grip member encapsulates the handle portion and the handle portion is disposed inside the grip member. The grip member may comprise a thermoplastic material overmolded on the handle portion of the body.

In an embodiment, a charging handle for use with a rifle comprises a body including a handle portion, a bolt engaging portion and a shaft portion. The rifle comprises an upper receiver and a bolt carrier that is slidingly received in the upper receiver. The upper receiver comprises an upper receiver wall having inner surfaces defining a channel and outer surfaces defining a depression. The shaft portion of the charging handle extends in a forward direction from the handle portion to the bolt engaging portion and in a rearward direction from the bolt engaging portion to the handle portion. The shaft portion is configured and dimensioned to extend into the channel defined by the inner surfaces of the upper receiver.

The bolt engaging portion of the charging handle comprises a projection configured and dimensioned to engage the bolt carrier of the rifle for pulling the bolt carrier in the rearward direction. In one or more embodiments, the projection extends in a downward direction beyond a lower surface of the shaft portion. The handle portion comprises a starboard arm extending away from the shaft portion in a starboard direction and a port arm extending away from the shaft portion in a portward direction. In one or more embodiments, the handle portion defines a first hole and a second hole. In one or more embodiments, the first hole and the second hole are both positioned between the starboard arm and the port arm.

The charging handle comprises a strut portion that extends away from the handle portion in the forward direction. The strut portion defines an aperture having a first opening and a second opening. The first opening of the aperture extends through a starboard facing surface of the strut portion. The second opening extends through a port facing surface of the strut portion. The strut portion is offset from the shaft portion by an offset distance so that a slot is defined between the starboard facing surface of the strut portion and a port facing surface of the shaft portion. The slot has a width corresponding to the offset distance. In one or more embodiments, the slot is dimensioned to receive a portion of the upper receiver wall which extends into the slot when the charging handle is in a fully inserted position. The slot is disposed in fluid communication with the aperture.

The charging handle includes a latch member comprising a rearward portion, a first ramp portion disposed forward of the rearward portion, a foot portion disposed forward of the first ramp portion, and a second ramp portion disposed forward of the foot portion. The latch member comprises a first bend disposed between rearward portion and the first ramp portion. In one or more embodiments, the first bend is configured such that the first ramp portion extends away from the rearward portion in a starboard, forward direction SF. The latch member comprises a second bend disposed between the first ramp portion and the foot portion. In one or more embodiments, the second bend is configured such that the foot portion extends away from the first ramp portion in the forward direction. The latch member comprises a third bend disposed between the foot portion and the second ramp portion. In one or more embodiments, the third bend is configured such that the second ramp portion extends away from the foot portion in a portward, forward direction PF. In one or more embodiments, the first ramp portion and the second ramp portion both extending through the first opening when the latch member is free to assume a relaxed state with no external forces deforming it. In one or more embodiments, the foot portion of the latch member is dimensioned and configured to be received in the depression defined by the outer surfaces of the upper receiver wall when the charging handle is in the fully inserted position.

The charging handle comprises a grip member disposed about the handle portion of the body so that the handle portion is disposed inside a cavity defined by the grip member. In one or more embodiments, the grip member comprises a first bridging portion extending in the upward and downward directions through the first hole and a second bridging portion extending in the upward direction and downward directions through the second hole to mechanically interlock the grip member and the handle portion to one another. In one or more embodiments, the grip member comprises a plurality of grooves and a plurality of ribs. In one or more embodiments, each groove has a groove base surface extending between a pair of ribs and each rib extends forwardly beyond one or more adjacent groove base surfaces.

In one or more embodiments, the rearward portion of the latch member defines a through hole. In one or more embodiments, a screw extends through the through hole and fixes the latch member to the body. In one or more embodiments, the body of the charging handle defines a threaded hole and a distal portion of the screw is received in the treaded hole with male threads of the screw in threaded engagement with female threads of the threaded hole.

In an embodiment, a charging handle comprises a body having a handle portion, a bolt engaging portion, a strut portion, and a shaft portion. In an embodiment, the shaft portion extends forwardly from the handle portion to the bolt engaging portion. The shaft portion may be dimensioned to extend into a channel defined by the inner surfaces of the upper receiver of a rifle. In an embodiment, the bolt engaging portion of the body comprises a projection configured and dimensioned to engage the bolt of the rifle for pulling the bolt in the rearward direction as the charging handle is pulled rearward from a fully inserted position to a more rearward position. The handle portion of the body may have a starboard arm extending away from the shaft portion in a starboard direction and a port arm extending away from the shaft portion in a portward direction. In an embodiment, the strut portion extends away from the handle portion in the forward direction with the strut portion being offset from the shaft portion by an offset distance so that a slot is defined between a starboard facing surface of the strut portion and a port facing surface of the shaft portion. In an embodiment, the offset distance is selected so that a portion of the upper receiver wall of the rifle is received in the slot when the charging handle is in the fully inserted position. The strut portion may define an aperture communicating with the slot. In an embodiment, the charging handle also includes a latch member comprising a leaf spring. A rearward portion of the latch member may be fixed to the body of the charging handle and a forward portion of the latch member may be disposed in the aperture defined by the strut portion. In an embodiment, the latch member includes a foot portion receivable in a depression defined by the upper receiver wall when the charging handle is in the fully inserted position and the leaf spring is configured to deflect allowing the foot portion to exit the depression when the charging handle is pulled rearward from the fully inserted position to a more rearward position. In an embodiment, the charging handle comprises a grip member disposed about the handle portion of the body so that the grip member encapsulates the handle portion and the handle portion is disposed inside the grip member. In an embodiment, the grip member comprises a first bridging portion extending in the upward and downward directions through a first hole defined by the handle portion and a second bridging portion extending in the upward direction through a second hole defined by the handle portion to mechanically interlock the grip member and the handle portion to one another. The grip member may comprise a thermoplastic material overmolded on the handle portion of the body.

In an embodiment, the latch member comprises the rearward portion, a first ramp portion disposed forward of the rearward portion, a foot portion disposed forward of the first ramp portion, and a second ramp portion disposed forward of the foot portion. In an embodiment, the charging handle is configures so that the second ramp portion of the leaf spring contacts and a leaf spring engaging portion of the upper receiver wall during forward translation of the charging handle toward a fully inserted position. In an embodiment, the leaf spring engaging portion of the upper receiver wall applies a engagement force to the second ramp portion during forward translation of the charging handle toward the forwardmost position. In an embodiment, the orientation of the second ramp portion relative to a longitudinal axis of the charging handle is such that the wall force has a rearwardly directed component and a portwardly directed component and the portwardly directed component acts to deflect the leaf spring in a cantilevered fashion.

A charging handle in accordance with an example embodiment comprises a body having a handle portion, a bolt engaging portion, a strut portion, and a shaft portion. In an embodiment, the shaft portion extends forwardly from the handle portion to the bolt engaging portion. The shaft portion may be dimensioned to extend into a channel defined by the inner surfaces of the upper receiver of a rifle. In an embodiment, the bolt engaging portion of the body comprises a projection configured and dimensioned to engage the bolt of the rifle for pulling the bolt in the rearward direction as the charging handle is pulled rearward from a fully inserted position to a more rearward position. The handle portion of the body may have a starboard arm extending away from the shaft portion in a starboard direction and a port arm extending away from the shaft portion in a portward direction. In an embodiment, the strut portion extends away from the handle portion in the forward direction with the strut portion being offset from the shaft portion by an offset distance so that a slot is defined between a starboard facing surface of the strut portion and a port facing surface of the shaft portion. In an embodiment, the offset distance is selected so that a portion of the upper receiver wall of the rifle is received in the slot when the charging handle is in the fully inserted position. The strut portion may define an aperture communicating with the slot. In an embodiment, the charging handle also includes a latch member comprising a leaf spring. A rearward portion of the latch member may be fixed to the body of the charging handle and a forward portion of the latch member may be disposed in the aperture defined by the strut portion. In an embodiment, the latch member includes a foot portion receivable in a depression defined by the upper receiver wall when the charging handle is in the fully inserted position and the leaf spring is configured to deflect allowing the foot portion to exit the depression when the charging handle is pulled rearward from the fully inserted position to a more rearward position.

In an embodiment, the charging handle comprises a grip member disposed about the handle portion of the body so that the grip member encapsulates the handle portion and the handle portion is, disposed inside the grip member. In an embodiment, the grip member comprises a first bridging portion extending in the upward and downward directions through a first hole defined by the handle portion and a second bridging portion extending in the upward direction through a second hole defined by the handle portion to mechanically interlock the grip member and the handle portion to one another. The grip member may comprise a thermoplastic material overmolded on the handle portion of the body.

In an embodiment, the latch member comprises the rearward portion, a first ramp portion disposed forward of the rearward portion, a foot portion disposed forward of the first ramp portion, and a second ramp portion disposed forward of the foot portion. In an embodiment, the charging handle is configures so that the second ramp portion of the leaf spring contacts and a leaf spring engaging portion of the upper receiver wall during forward translation of the charging handle toward a fully inserted position. In an embodiment, the leaf spring engaging portion of the upper receiver wall applies an engagement force to the second ramp portion during forward translation of the charging handle toward the forwardmost position. In an embodiment, the orientation of the second ramp portion relative to a longitudinal axis of the charging handle is such that the engagement force has a rearwardly directed component and a portwardly directed component and the portwardly directed component acts to deflect the leaf spring in a cantilevered fashion.

A charging handle in accordance with an example embodiment comprises a body having a handle portion, a bolt engaging portion, a strut portion, and a shaft portion. In an embodiment, the shaft portion extends forwardly from the handle portion to the bolt engaging portion. The shaft portion may be dimensioned to extend into a channel defined by the inner surfaces of the upper receiver of a rifle. In an embodiment, the bolt engaging portion of the body comprises a projection configured and dimensioned to engage the bolt of the rifle for pulling the bolt in the rearward direction as the charging handle is pulled rearward from a fully inserted position to a more rearward position. The handle portion of the body may have a starboard arm extending away from the shaft portion in a starboard direction and a port arm extending away from the shaft portion in a portward direction. In an embodiment, the strut portion extends away from the handle portion in the forward direction with the strut portion being offset from the shaft portion by an offset distance so that a slot is defined between a starboard facing surface of the strut portion and a port facing surface of the shaft portion. In an embodiment, the offset distance is selected so that a portion of the upper receiver wall of the rifle is received in the slot when the charging handle is in the fully inserted position. In an embodiment, the charging handle comprises a grip member disposed about the handle portion of the body so that the grip member encapsulates the handle portion and the handle portion is disposed inside the grip member. In an embodiment, the grip member comprises a first bridging portion extending in the upward and downward directions through a first hole defined by the handle portion and a second bridging portion extending in the upward direction through a second hole defined by the handle portion to mechanically interlock the grip member and the handle portion to one another. The grip member may comprise a thermoplastic material overmolded on the handle portion of the body. In an embodiment, the grip member comprises a plurality of grooves and a plurality of ribs, each groove having a groove base surface extending between a pair of ribs, each rib extending forwardly beyond one or more adjacent groove base surfaces.

A feature and benefit of embodiments is a charging handle that does not require a user to rotate a lever prior to pulling the charging handle rearward to charge a rifle.

A feature and benefit of embodiments is a charging handle allow the use of either the left hand or the right hand to charge a rifle. The motion used to charge the rifle is the same for both the right hand and the left hand.

A feature and benefit of embodiments is a charging handle including a leaf spring providing a latching function and a strut providing a guarding function for the leaf spring. The leaf spring is disposed inside an aperture defined by the strut portion and the strut portion prevents the leaf spring from snagging on objects such as, for example, clothing and underbrush.

A feature and benefit of embodiments is a charging handle including a plurality of grooves and ribs that reduce the likelihood that the users hand will slip off the charging handle even in adverse (e.g., battlefield) conditions. At the same time, abrasion to the user's hand is reduced by providing grip member comprising a relatively soft material. In an embodiment, the grip member comprises a first material having a first hardness, the charging handle body comprises a second material having a second hardness, and the second hardness is greater than the first hardness.

The above summary is not intended to describe each illustrated embodiment or every implementation of the present disclosure.

BRIEF DESCRIPTION OF THE FIGURES

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

In FIG. 7A, a section line C-C is shown extending across a shaft portion and a strut portion of a body of the charging handle.

Figure 1:
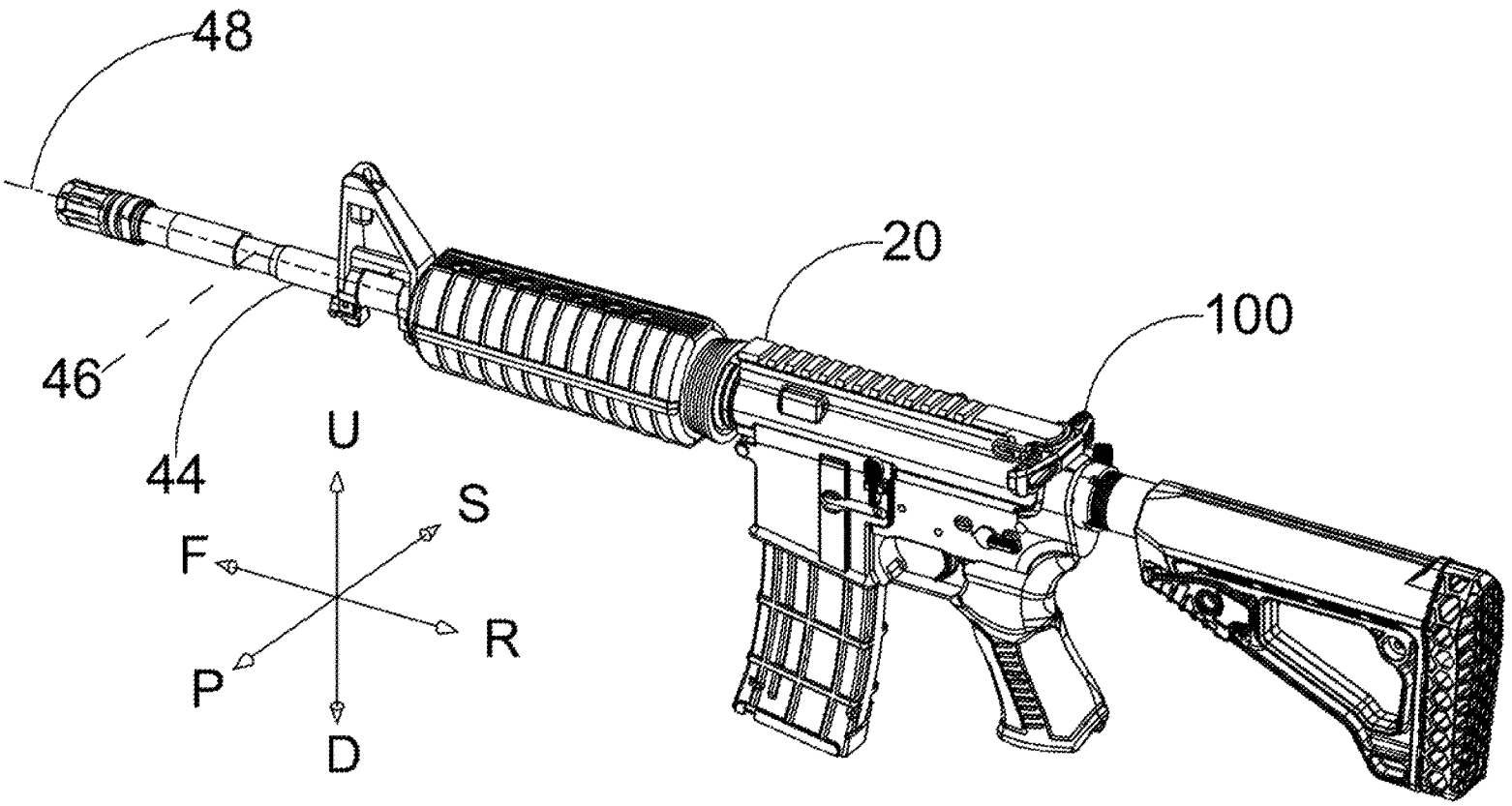
FIG. 1 is a perspective view showing a modern sporting rifle including a charging handle.

While embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Figure 2:
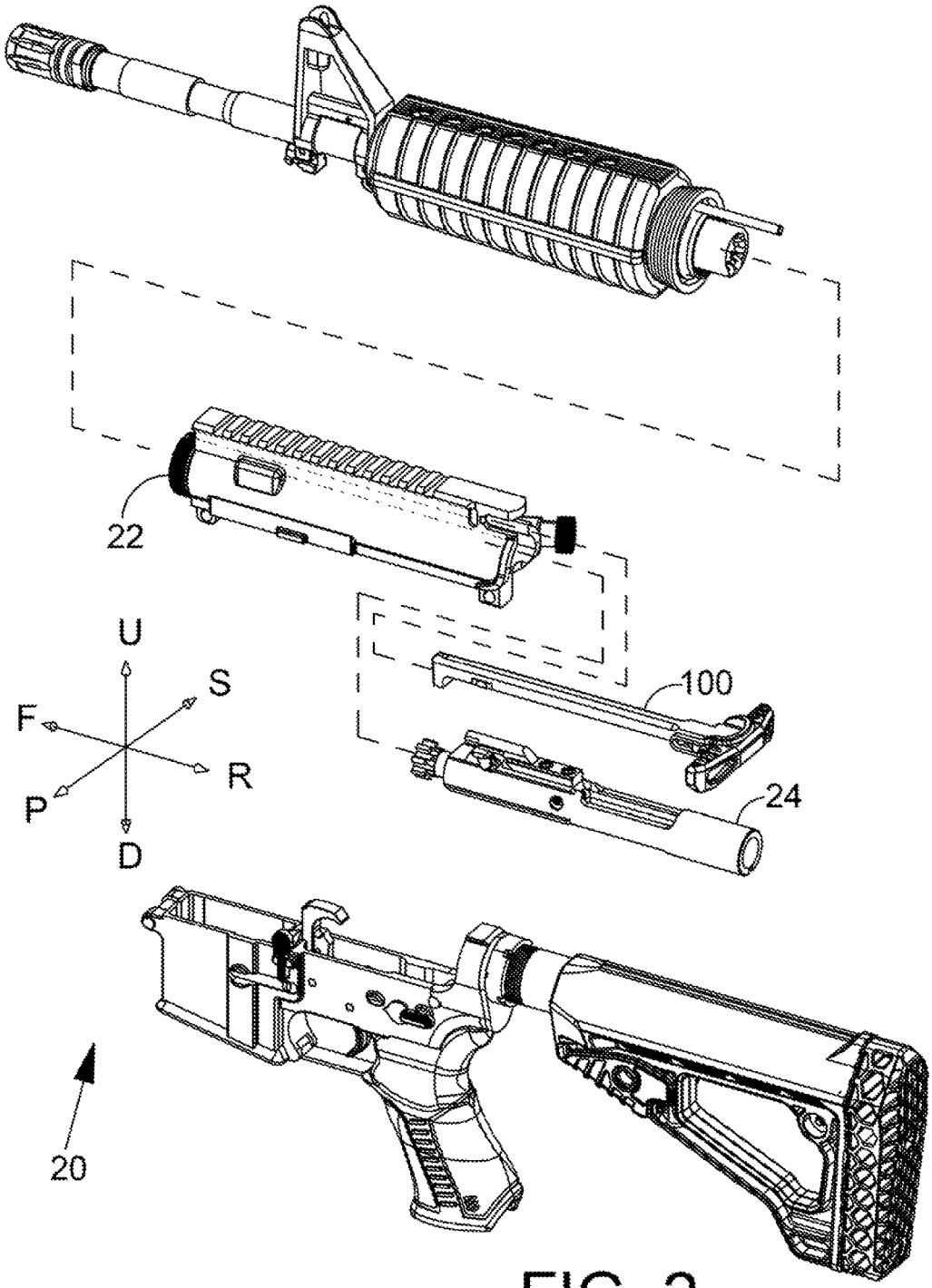
FIG. 2 is a partially exploded view of the modern sporting rifle shown in FIG. 1. The modern sporting rifle includes a charging handle, a bolt carrier and an upper receiver.
Figure 3:
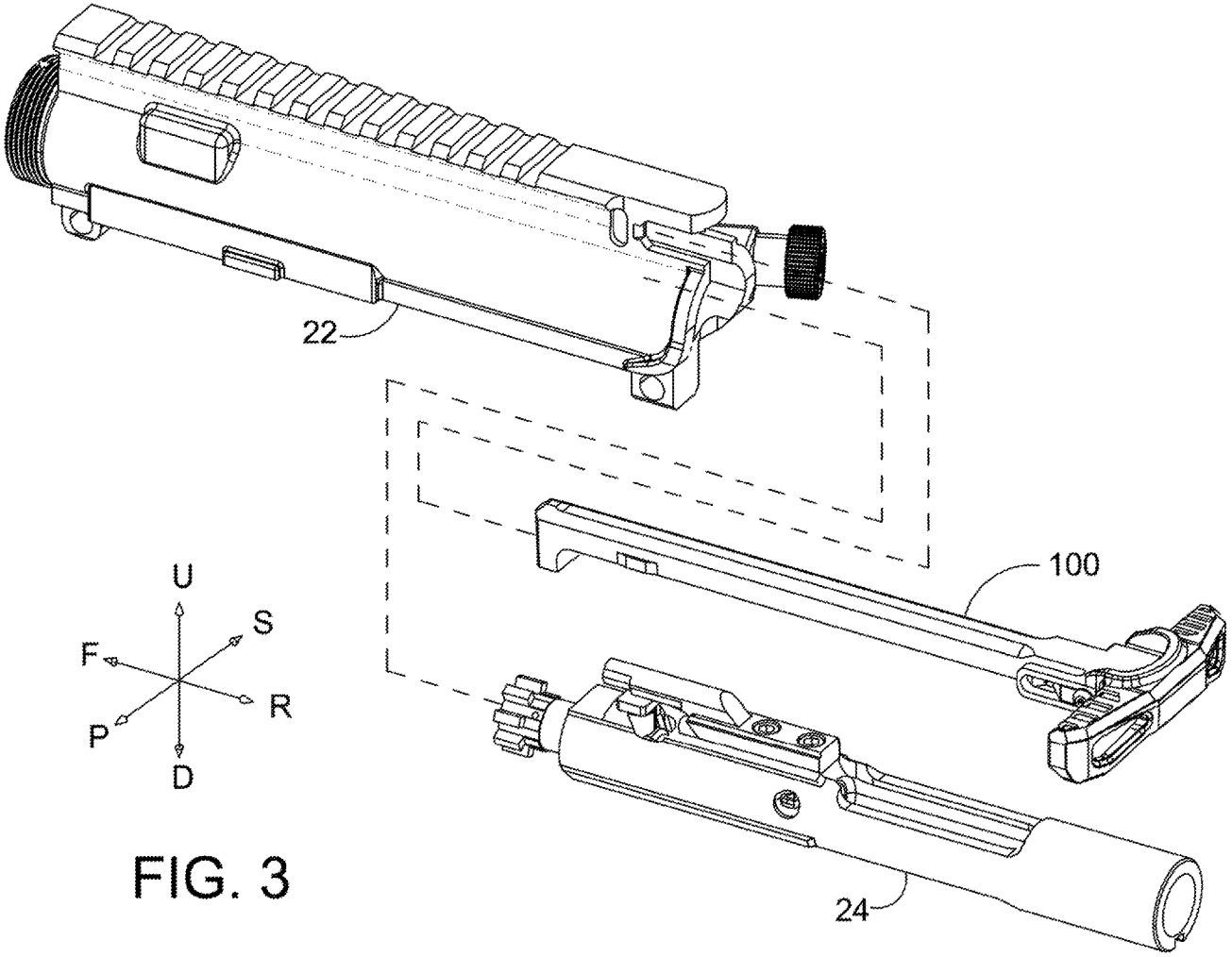
FIG. 3 is an enlarged (relative to FIG. 2) exploded view of an assembly including a charging handle, a bolt carrier and an upper receiver.

Referring to FIG. 1, a perspective of a modern sporting rifle 20 including a charging handle 100 is shown. The rifle 20 has a barrel 44 defining a bore 46. The bore 46 extends along a gun bore axis 48. The gun bore axis 48 extends in a forward direction F and a rearward direction R. FIG. 2 is a partially exploded view of the modern sporting rifle 20 shown in FIG. 1. The modern sporting rifle 20 includes a charging handle 100, a bolt carrier 24 and an upper receiver 22. FIG. 3 is an enlarged (relative to FIG. 2) exploded view of an assembly including a charging handle 100, a bolt carrier 24 and an upper receiver 22.

Figure 4:
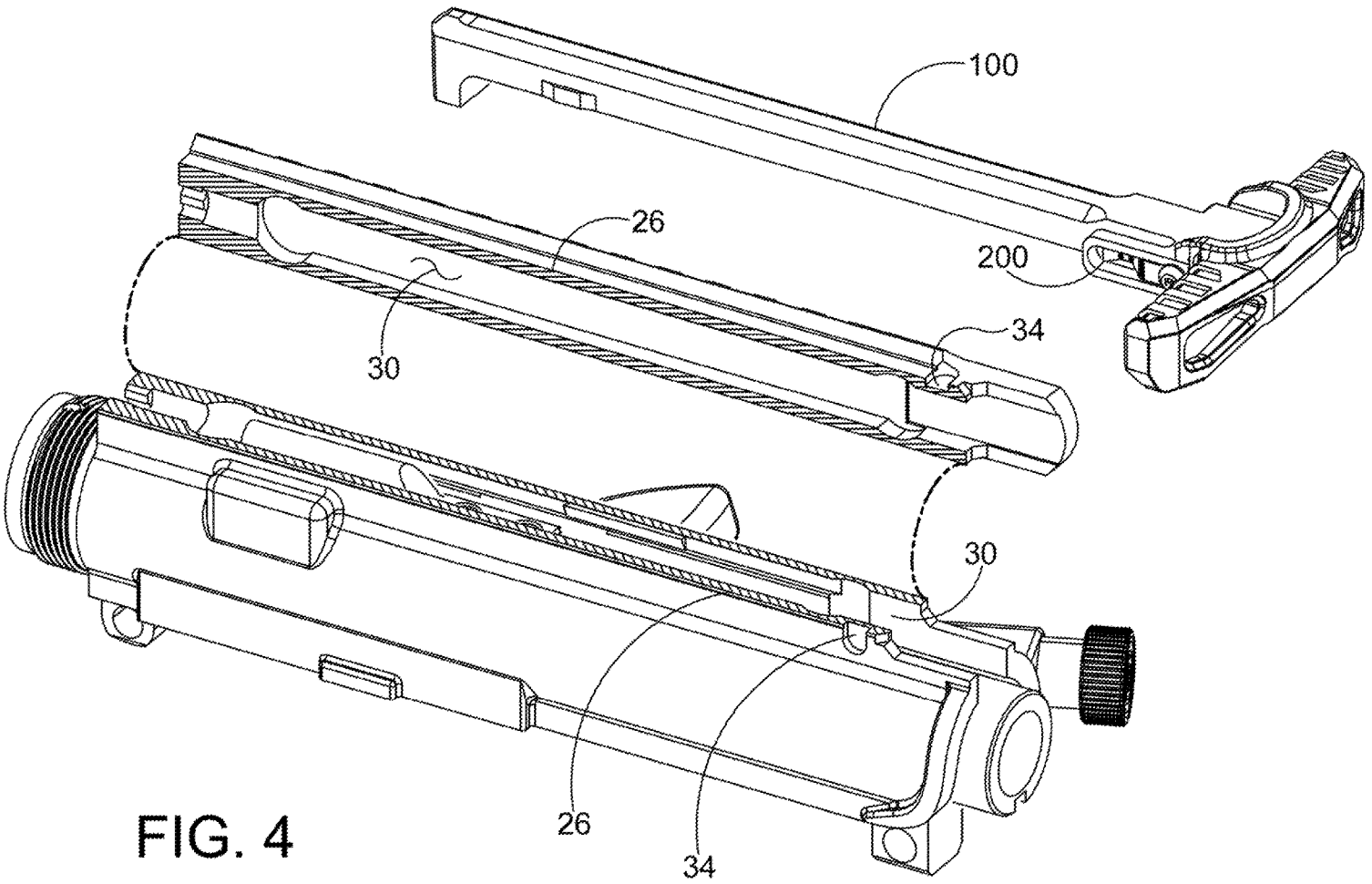
FIG. 4 is a partially exploded view of an assembly including a charging handle, a bolt carrier and an upper receiver. The upper receiver of FIG. 4 is cross-sectioned into a first part and a second part, the two parts being illustrated with different angles of projection.
Figure 5:
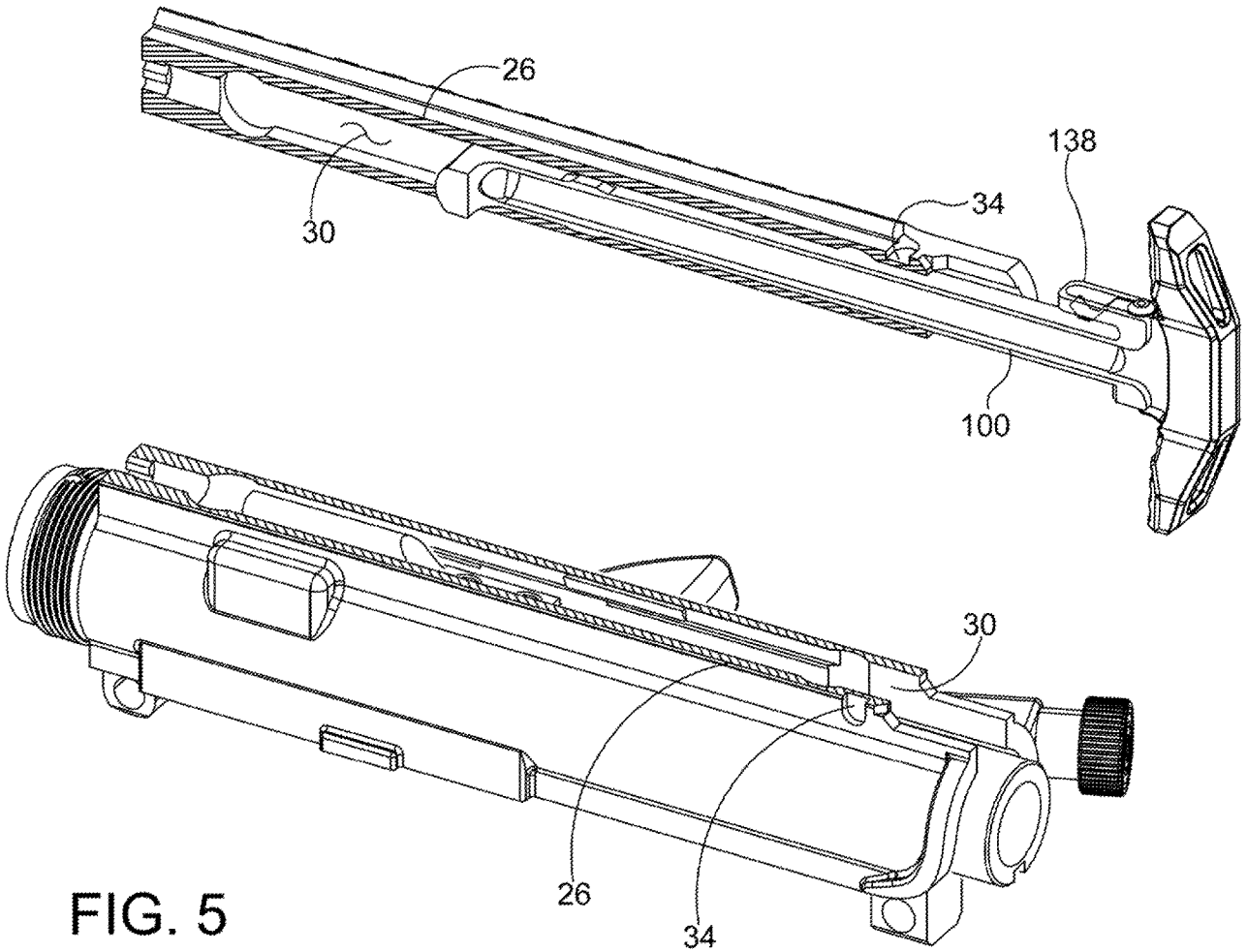
FIG. 5 is a partially exploded view of an assembly including a charging handle, a bolt carrier and an upper receiver. The charging handle is shown extending into a channel defined by the upper receiver in FIG. 5.
Figure 6A:
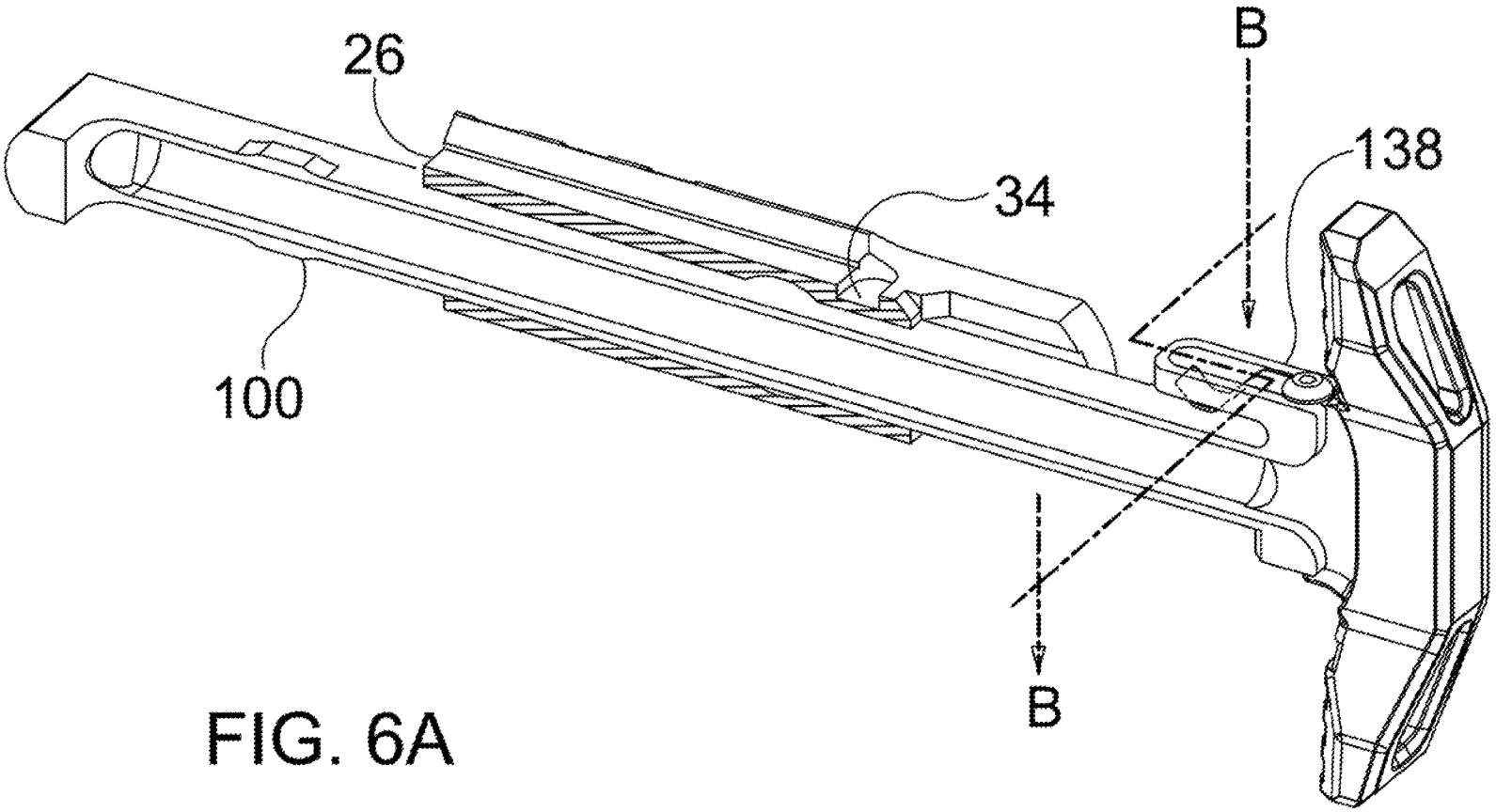
FIG. 6A is an enlarged (relative to FIG. 5) perspective view of an assembly including a charging handle and a portion of the upper receiver shown in FIG. 5. A section line B-B is shown in FIG. 6A.
Figure 6B:
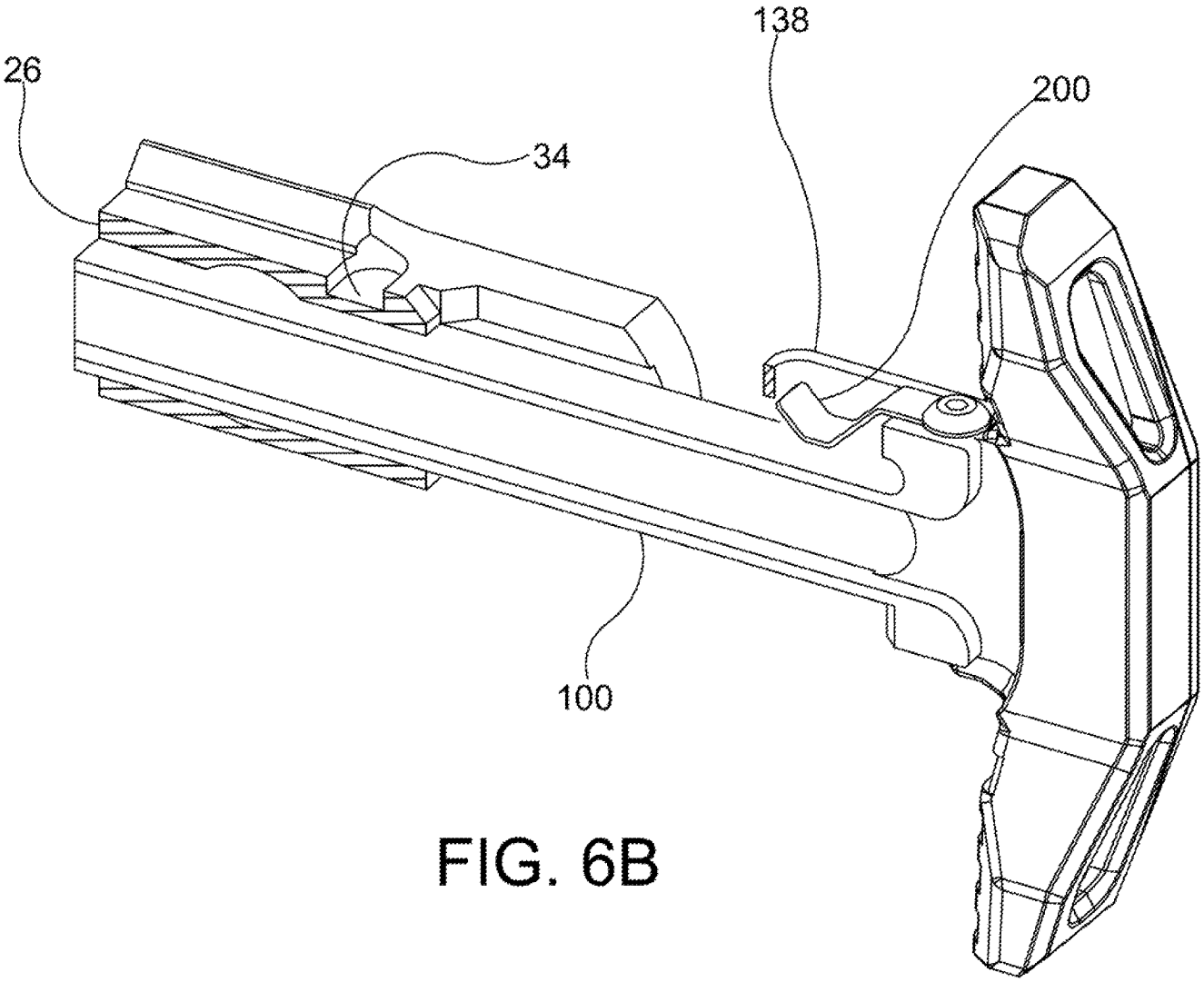
FIG. 6B is an enlarged (relative to FIG. 6A) perspective view of an assembly including a charging handle and a portion of the upper receiver shown in FIG. 6A. A strut portion of the charging handle has been sectioned along section line B-B (shown in FIG. 6A) in the embodiment of FIG. 6B.

Referring, for example, to FIGS. 4-6, a charging handle 100 for use with a rifle 20 comprises a body 120 including a handle portion 122, a bolt engaging portion 126, and a shaft portion 124. The rifle 20 comprises an upper receiver 22 and a bolt carrier 24 that is slidingly received in the upper receiver. The upper receiver 22 comprises an upper receiver wall 26 having inner surfaces 28 defining a channel 30 and outer surfaces 32 defining a depression 34.

Still referring to FIGS. 4-6, in embodiments, the shaft portion 124 of the charging handle 100 extends in a forward direction from the handle portion 122 to the bolt engaging portion 126 and in a rearward direction from the bolt engaging portion 126 to the handle portion 122. The shaft portion 124 is configured and dimensioned to extend into the channel 30 defined by the inner surfaces 28 of the upper receiver 22. The bolt engaging portion 126 of the charging handle 100 comprises a projection 128 configured and dimensioned to engage the bolt carrier 24 of the rifle 20 for pulling the bolt carrier 24 in the rearward direction. In one or more embodiments, the projection 128 extends in a downward direction beyond a lower surface of the shaft portion 124. The handle portion 122 comprises a starboard arm 130 extending away from the shaft portion 124 in a starboard direction and a port arm 132 extending away from the shaft portion 124 in a portward direction. In one or more embodiments, the handle portion 122 defines a first hole 134 and a second hole 136. In one or more embodiments, the first hole 134 and the second hole 136 are both positioned between the starboard arm 130 and the port arm 132.

Figure 6C:
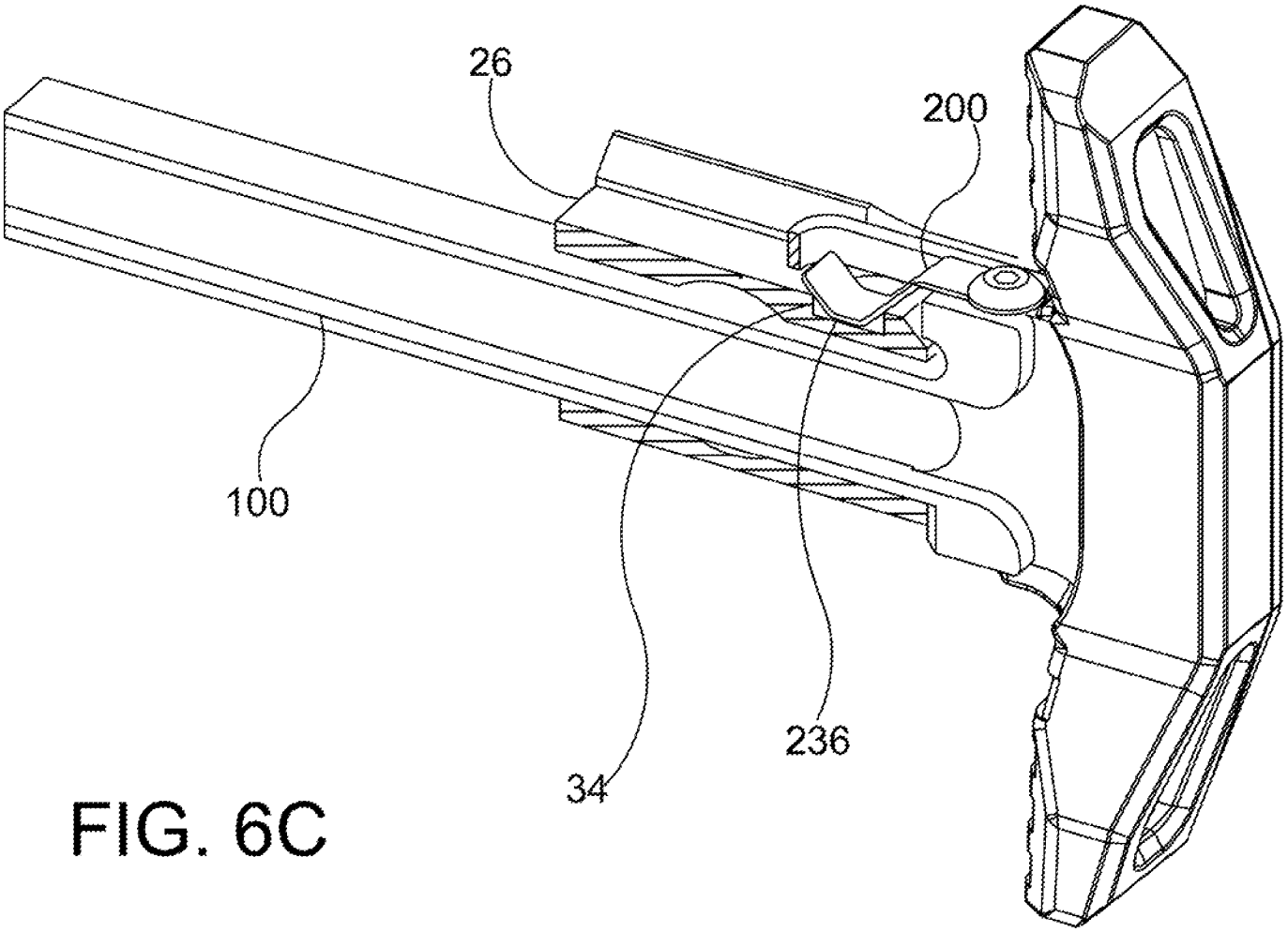
FIG. 6C is a perspective view of the assembly shown in FIG. 6B. In the embodiment of FIG. 6C, a foot portion of a latch member of the charging handle is received in a depression defined by outer surfaces of the upper receiver.
Figure 7B:
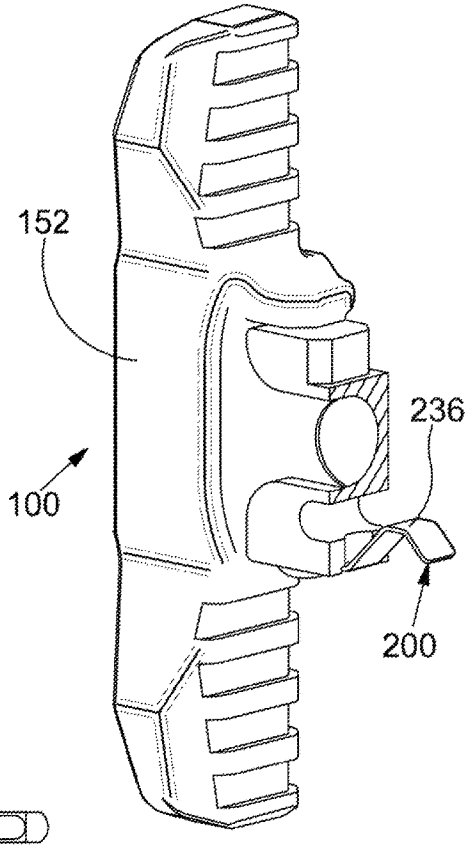
FIG. 7B is a perspective view of a charging handle that has been sectioned along section line C-C shown in FIG. 7A.
Figure 7A:
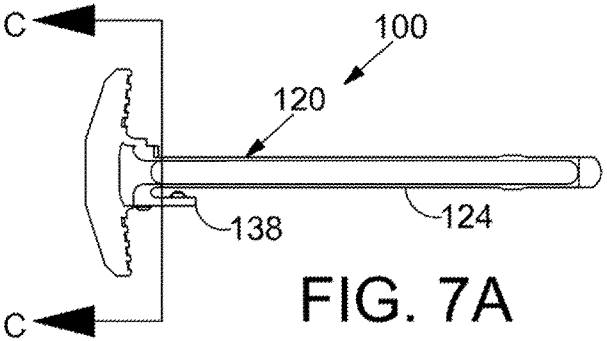
FIG. 7A is a bottom view of a charging handle in accordance with the detailed description.
Figure 7C:
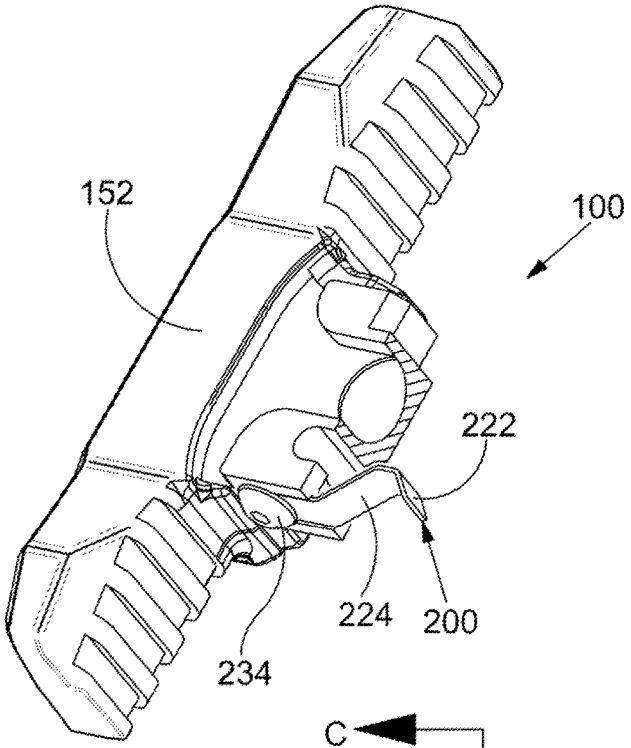
FIG. 7C is a perspective view of a charging handle that has been sectioned along section line C-C shown in FIG. 7A.
Figure 8:
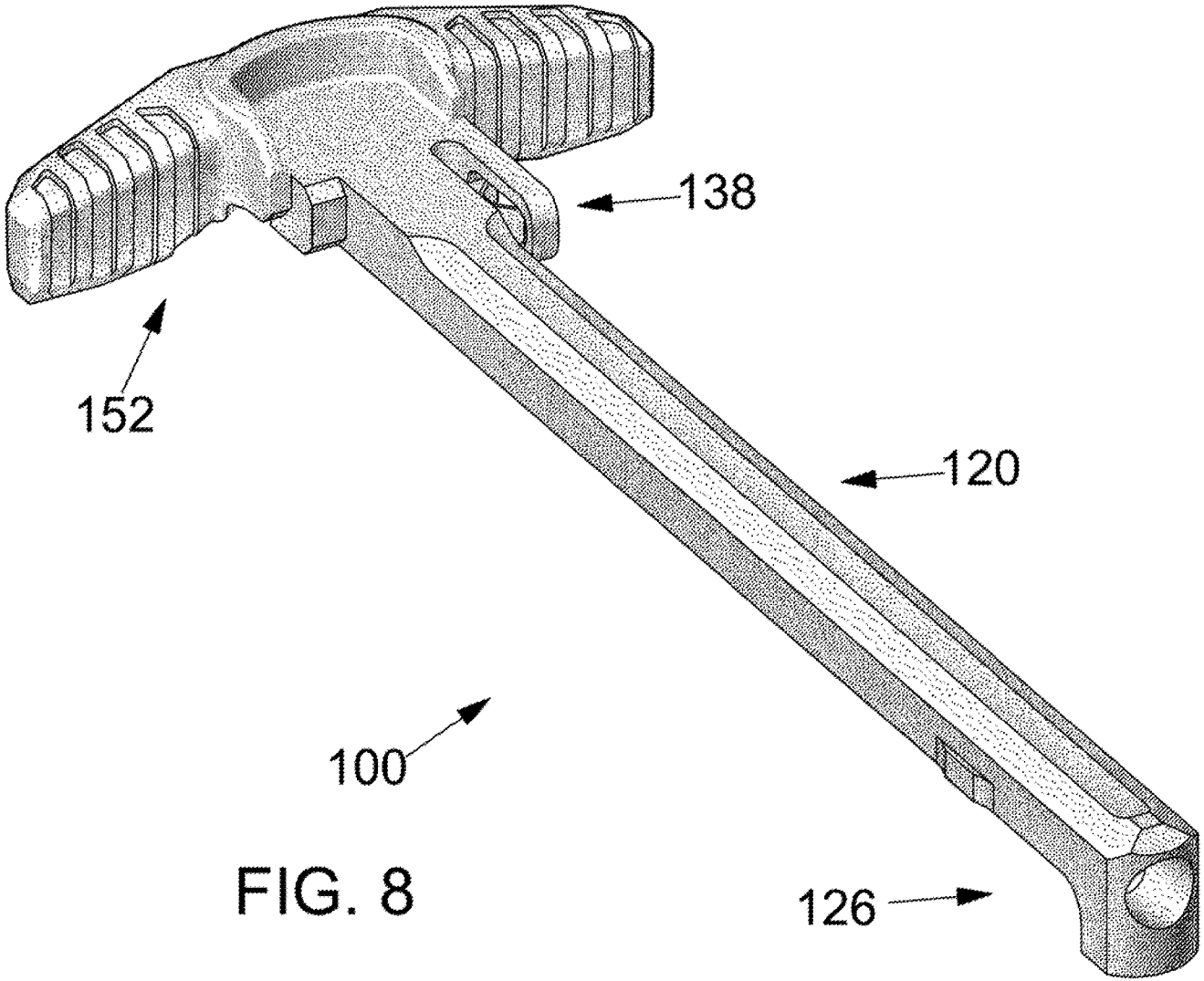
FIG. 8 is a perspective view of a charging handle in accordance with the detailed description.
Figure 9:
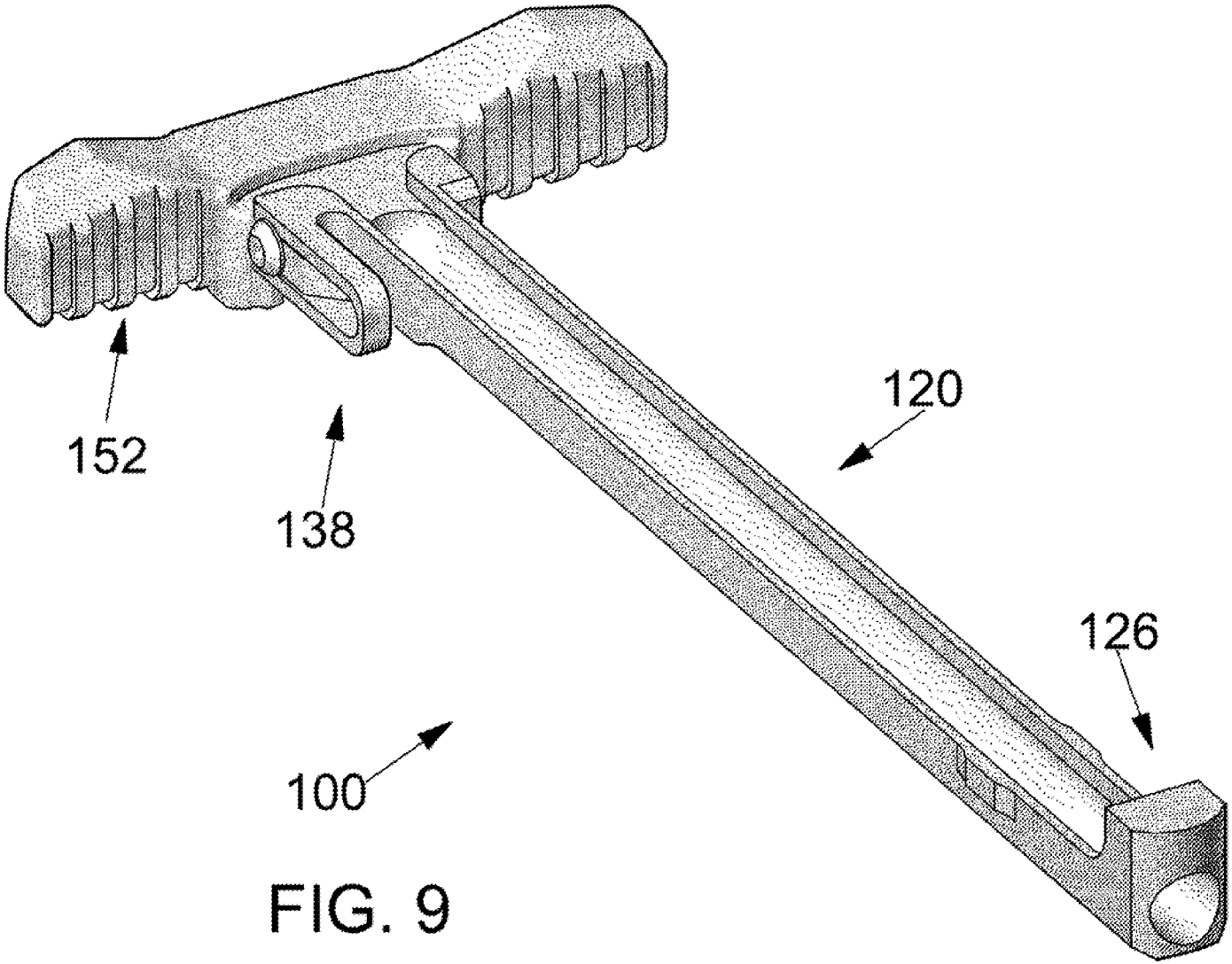
FIG. 9 is a perspective view of a charging handle in accordance with the detailed description.
Figure 10:
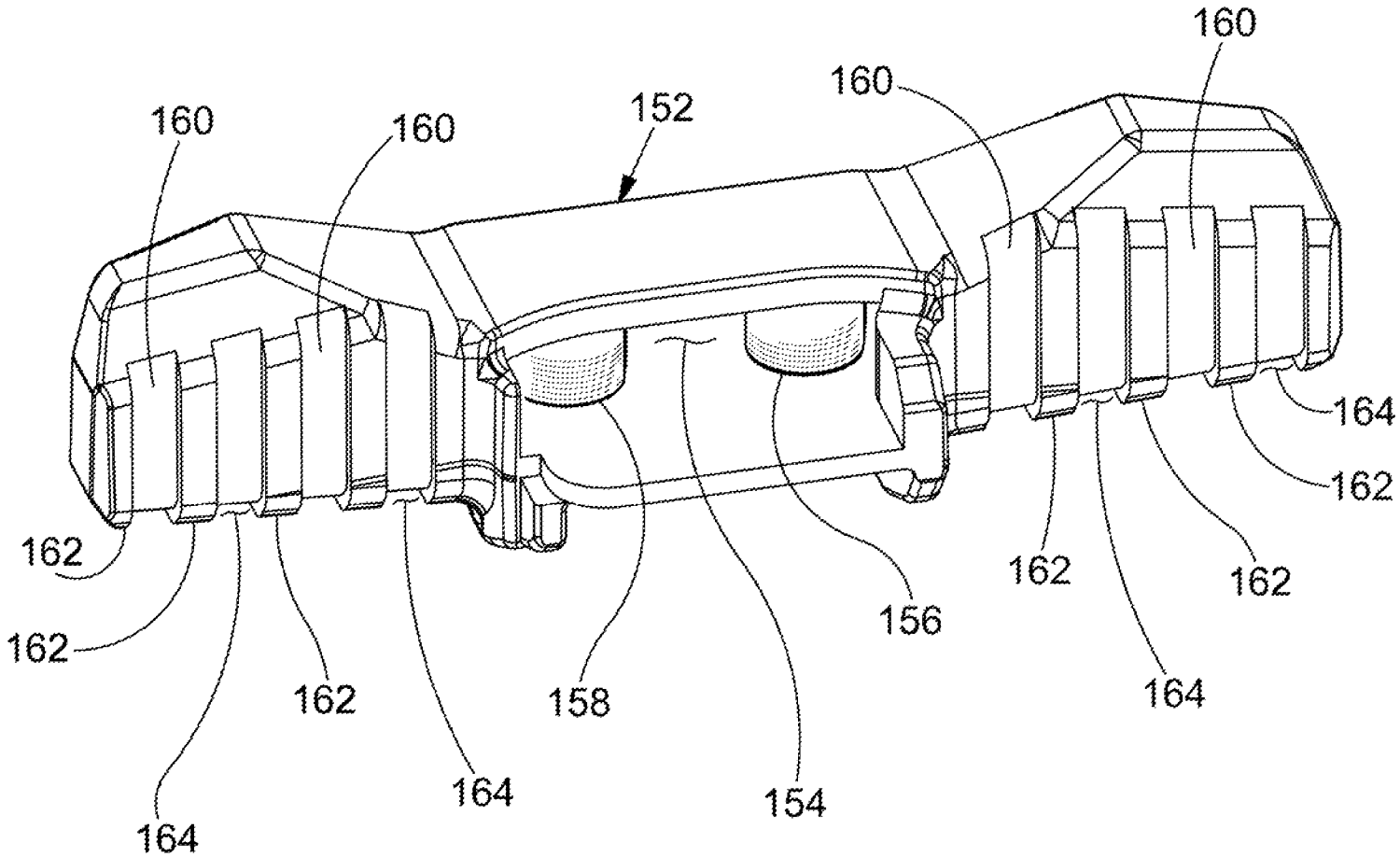
FIG. 10 is a perspective view showing a grip member that may be part of a charging handle in accordance with the detailed description.
Figure 11:
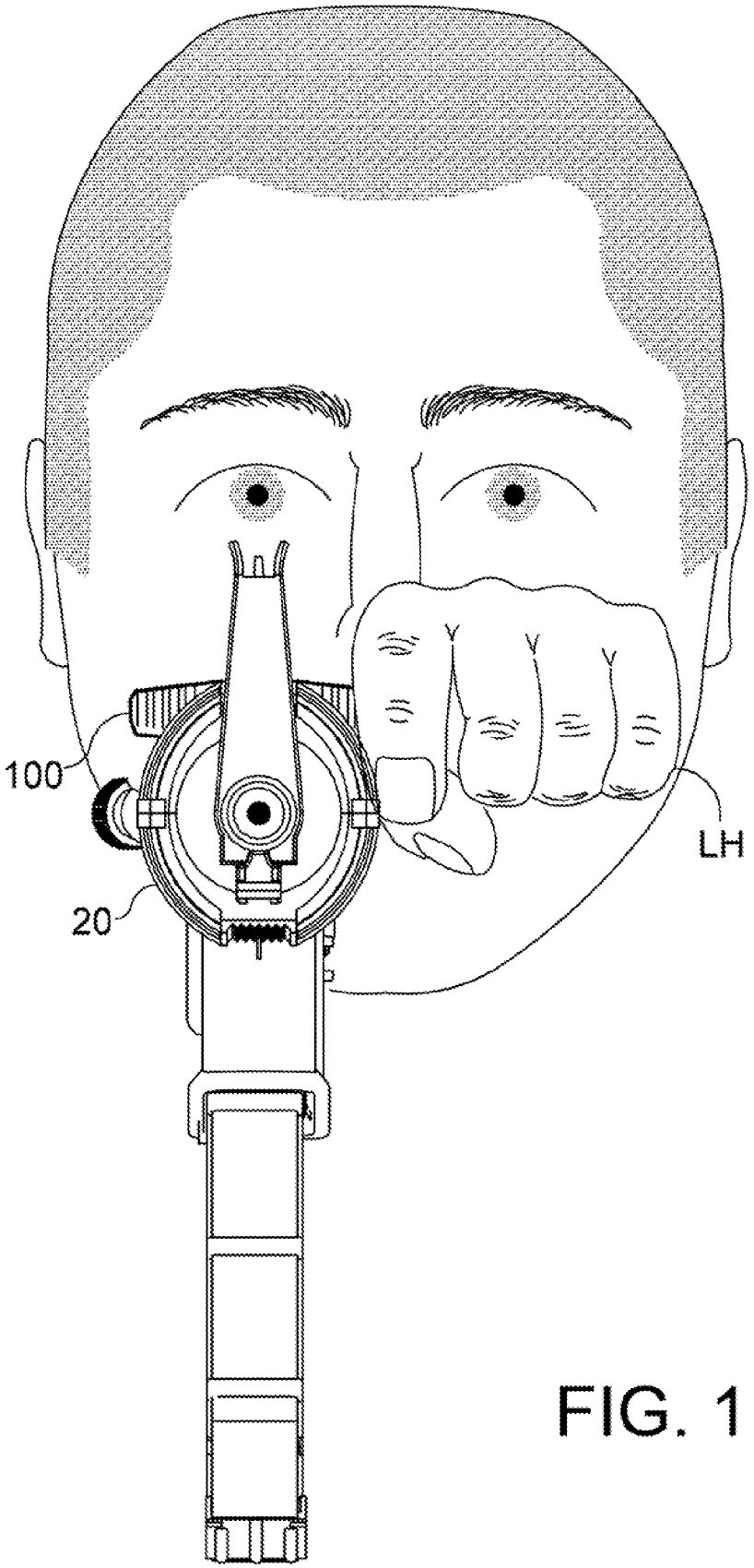
FIG. 11 is a front view of a rifle including a charging handle in accordance with the detailed description. In the example embodiment of FIG. 11, the left hand LH of a person is being used to operate the charging handle.
Figure 12:
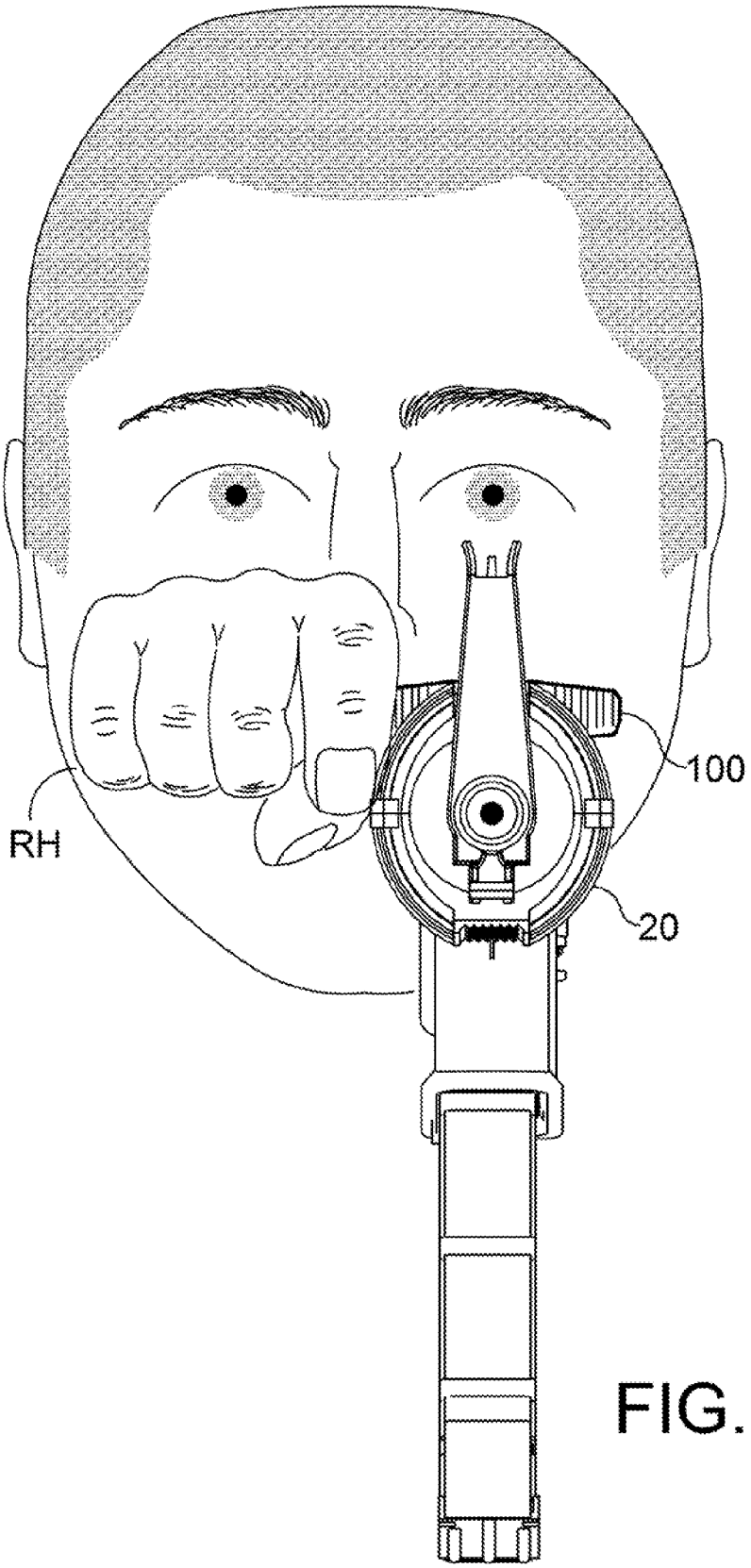
FIG. 12 is a front view of a rifle including a charging handle in accordance with the detailed description. In the example embodiment of FIG. 12, the right hand RH of a person is being used to operate the charging handle.
Figure 13A:
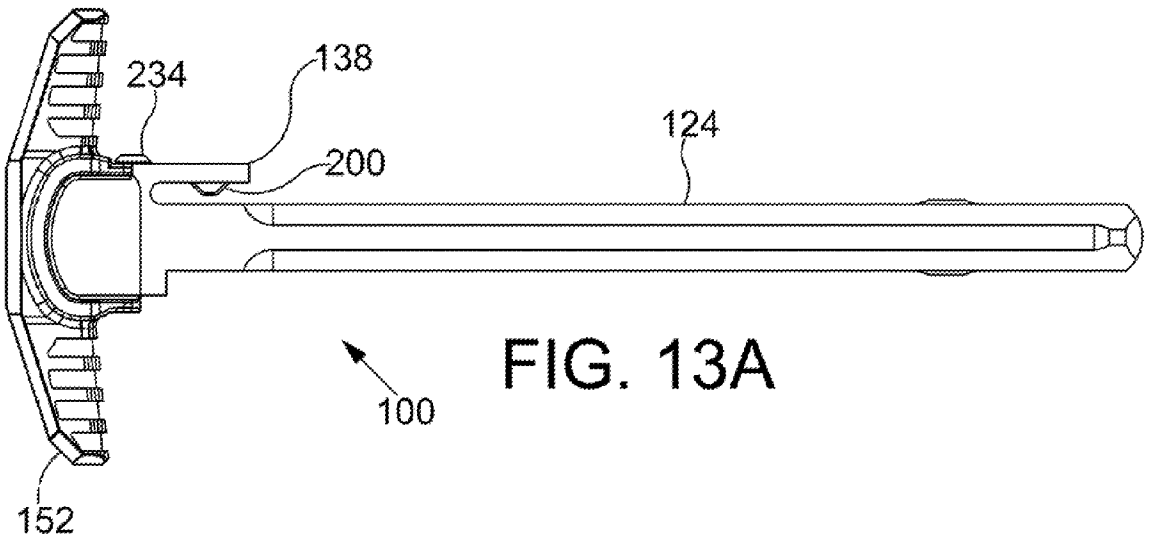
FIG. 13A through 13F are a group of top, bottom, front, rear, right side and left side views created using orthogonal projection. The views of FIG. 13A through FIG. 13F showing six sides of a charging handle in accordance with the detailed description.
Figure 13B:
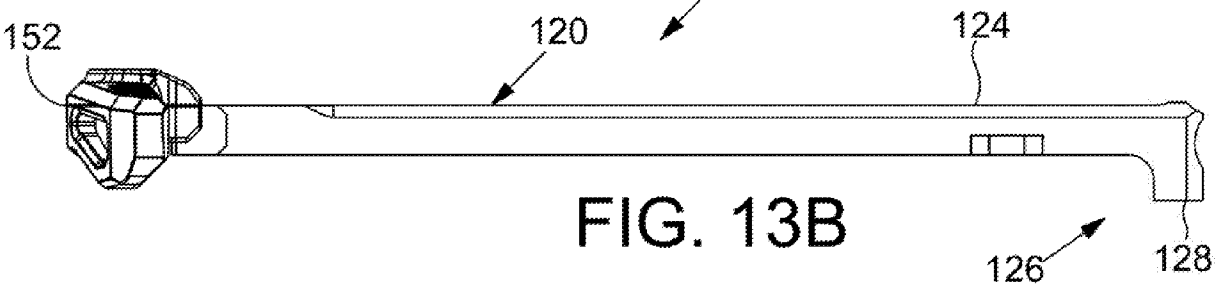
Figure 13C:
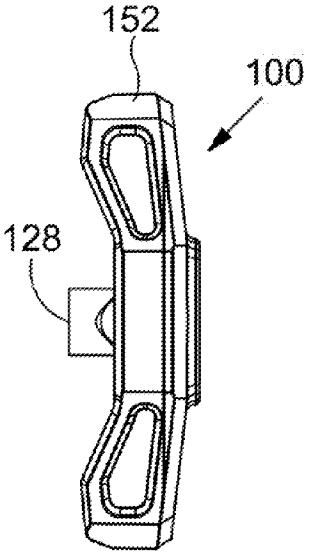
Figure 13F:
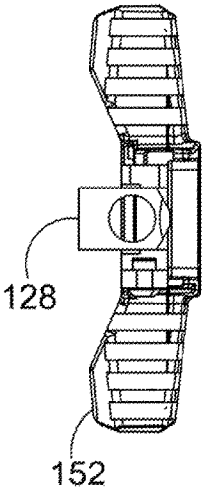
Figure 13D:
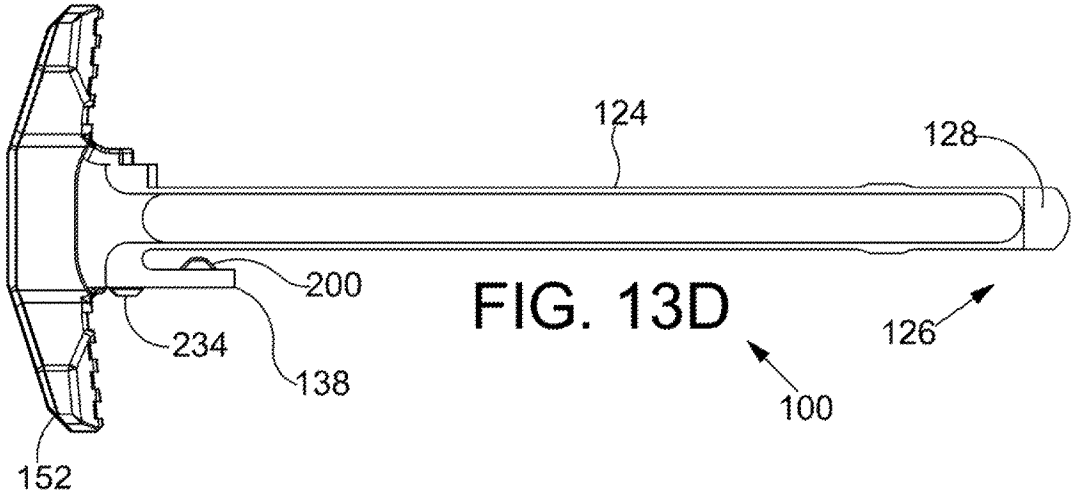
Figure 13E:
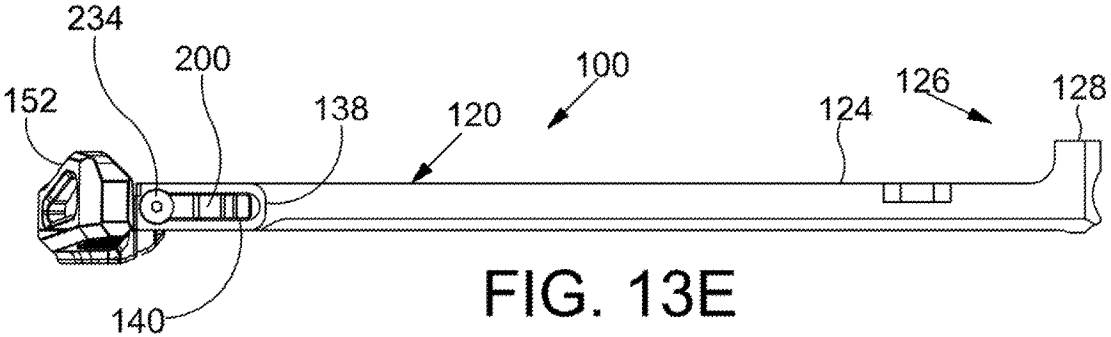

Referring to FIGS. 6C, 13D and 13E, in embodiments, the charging handle 100 comprises a strut portion 138 that extends away from the handle portion 122 in the forward direction. The strut portion 138 defines an aperture 140 having a first opening 142 and a second opening 144. The first opening of the aperture extends through a starboard facing surface 146 of the strut portion 138. The second opening 144 extends through a port facing surface 148 of the strut portion 138. The strut portion 138 is offset from the shaft portion 124 by an offset distance so that a slot 150 is defined between the starboard facing surface 146 of the strut portion 138 and a port facing surface 148 of the shaft portion 124. The slot 150 has a width corresponding to the offset distance. In one or more embodiments, the slot 150 is dimensioned to receive a portion of the upper receiver wall 26 which extends into the slot 150 when the charging handle 100 is in a fully inserted position. The slot 150 is disposed in fluid communication with the aperture 140.

Referring to FIGS. 6A-6C and 16A-16F, in embodiments, the charging handle 100 includes a latch member 200 comprising a rearward portion 220, a first ramp portion 222 disposed forward of the rearward portion 220, a foot portion 236 disposed forward of the first ramp portion 222, and a second ramp portion 224 disposed forward of the foot portion 236. The latch member 200 comprises a first bend 226 disposed between rearward portion 220 and the first ramp portion 222. In one or more embodiments, the first bend 226 is configured such that the first ramp portion 222 extends away from the rearward portion 220 in a starboard, forward direction SF. The latch member 200 comprises a second bend 228 disposed between the first ramp portion 222 and the foot portion 236. In one or more embodiments, the second bend 228 is configured such that the foot portion 236 extends away from the first ramp portion 222 in the forward direction. The latch member 200 comprises a third bend 230 disposed between the foot portion 236 and the second ramp portion 224. In one or more embodiments, the third bend 230 is configured such that the second ramp portion 224 extends away from the foot portion 236 in a portward, forward direction PF. In one or more embodiments, the first ramp portion 222 and the second ramp portion 224 both extending through the first opening 142 when the latch member 200 is free to assume a relaxed state with no external forces deforming it. In one or more embodiments, the foot portion 236 of the latch member 200 is dimensioned and configured to be received in the depression 34 defined by the outer surfaces 32 of the upper receiver wall 26 when the charging handle 100 is in the fully inserted position.

Referring to FIGS. 8-10 and 15A-15F, in embodiments, the charging handle comprises a grip member 152 disposed about the handle portion 122 of the body 120 so that the handle portion 122 is disposed inside a cavity 154 defined by the grip member 152. In one or more embodiments, the grip member 152 comprises a first bridging portion 156 extending in the upward and downward directions through the first hole 134 and a second bridging portion 158 extending in the upward direction and downward directions through the second hole 136 to mechanically interlock the grip member 152 and the handle portion 122 to one another. In one or more embodiments, the grip member 152 comprises a plurality of grooves 160 and a plurality of ribs 162. In one or more embodiments, each groove 160 has a groove base surface 164 extending between a pair of ribs 162 and each rib 162 extends forwardly beyond one or more adjacent groove base surfaces 164.

Figure 14A:
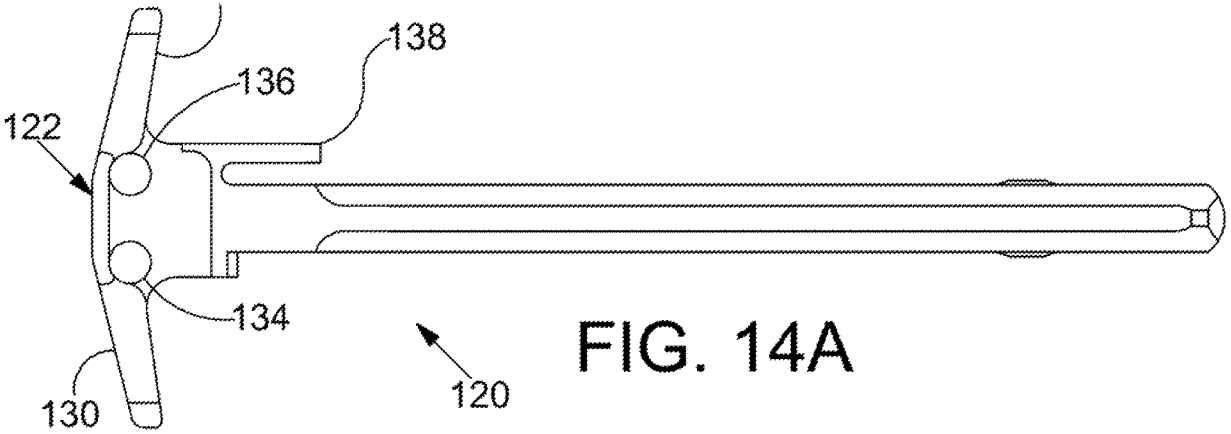
FIG. 14A through 14F are a group of top, bottom, front, rear, right side and left side views created using orthogonal projection. The views of FIG. 14A through FIG. 14F showing six sides of a charging handle body in accordance with the detailed description.
Figure 14B:
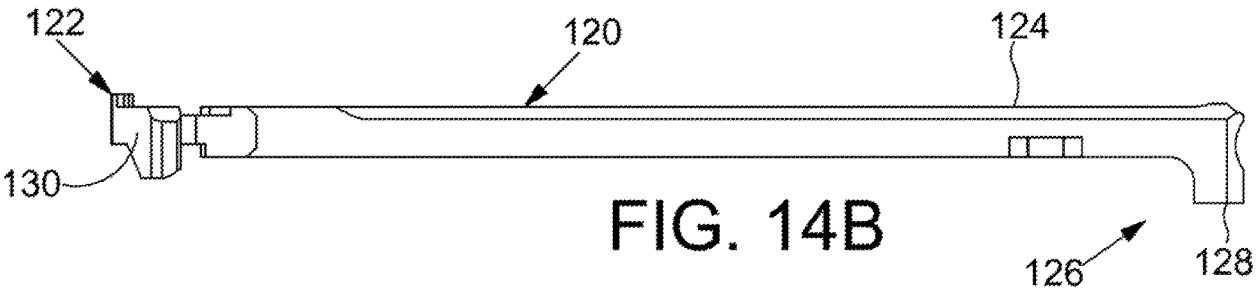
Figure 14C:
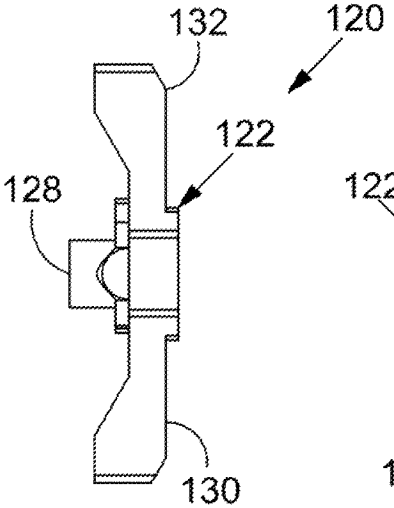
Figure 14F:
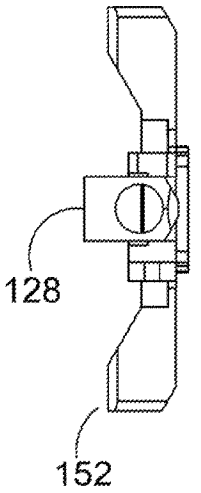
Figure 14D:
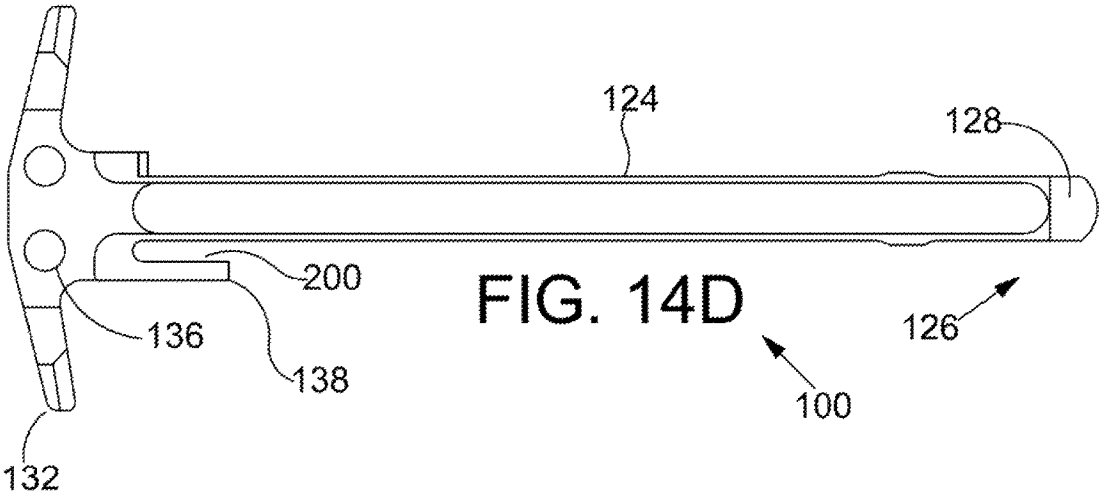
Figure 14E:
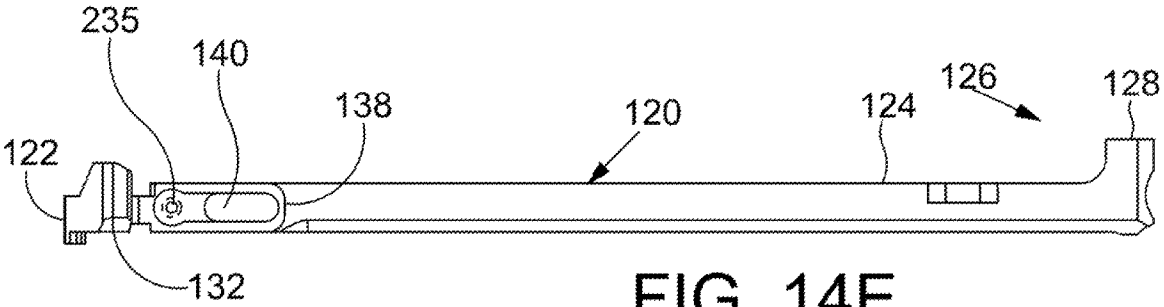

Referring to FIGS. 13E and 14E, in one or more embodiments, the rearward portion 220 of the latch member 200 defines a through hole 232. In one or more embodiments, a screw 234 extends through the through hole 232 and fixes the latch member 200 to the body 120. In one or more embodiments, the body 120 of the charging handle 100 defines a threaded hole 238 and a distal portion of the screw 234 is received in the treaded hole with male threads of the screw 234 in threaded engagement with female threads of the threaded hole 238.

Referring, for example, to FIG. 1, FIG. 2, FIG. 3, FIG. 16A and FIG. 16D, an upward direction U and a downward direction D are illustrated using arrows labeled "U" and "D." A forward direction F and a rearward direction R are illustrated using arrows labeled "F" and "R," respectively, in FIGS. 1 through 6. A right or starboard direction S and a left or port direction P are illustrated using arrows labeled "S" and "P," respectively, in FIGS. 1 and 4. These directions may be conceptualized, for example, from the point of view of a user who is holding a firearm and viewing a gunsight fixed to the firearm. In FIG. 1, a Y-axis is shown extending in the upward and downward directions and an X-axis is shown extending in the starboard and portward directions. A Z-axis is shown extending in forward and rearward directions in FIG. 1. The directions illustrated using these arrows and axes are applicable to the apparatus throughout this application. The port direction may also be referred to as the portward direction. In one or more embodiments, the upward direction is generally opposite the downward direction. In one or more embodiments, the upward direction and the downward direction are both generally orthogonal to an XZ plane defined by the forward direction and the starboard direction. In one or more embodiments, the forward direction is generally opposite the rearward direction. In one or more embodiments, the forward direction and the rearward direction are both generally orthogonal to an XY plane defined by the upward direction and the starboard direction. In one or more embodiments, the starboard direction is generally opposite the port direction. In one or more embodiments, starboard direction and the port direction are both generally orthogonal to a ZY plane defined by the upward direction and the forward direction. Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "backwardly," "portwardly," and "starboard," should not be interpreted to limit the scope of the invention recited in the attached claims.

FIG. 13A through FIG. 13F are a collection of views showing six sides of a charging handle 100. Engineer graphics textbooks generally refer to the process used to create views showing six sides of a three dimensional object as multiview projection or orthographic projection. It is customary to refer to multiview projections using terms such as front view, right side view, top view, rear view, left side view, and bottom view. In accordance with this convention, FIG. 13A may be referred to as a top view of the charging handle 100, FIG. 13B may be referred to as a right side view of the charging handle 100, and FIG. 13C may be referred to as a rear view of the charging handle 100. FIG. 13A through FIG. 13F may be referred to collectively as FIG. 13. Terms such as front view and right side view are used herein as a convenient method for differentiating between the views shown in FIG. 13. It will be appreciated that the elements shown in FIG. 13 may assume various orientations without deviating from the spirit and scope of this detailed description. Accordingly, the terms front view, right side view, top view, rear view, left side view, bottom view, and the like should not be interpreted to limit the scope of the invention recited in the attached claims. FIG. 13D may be referred to as a bottom view of the charging handle 100, FIG. 13E may be referred to as a left side view of the charging handle 100, and FIG. 13F may be referred to as a front view of the charging handle 100.

FIG. 14A through FIG. 14F are a collection of views showing six sides of a charging handle body 120. In the field of engineer graphics, the process used to create views showing six sides of a three dimensional object may be referred to as multiview projection or orthographic projection. It is customary to refer to multiview projections using terms such as front view, right side view, top view, rear view, left side view, and bottom view. In accordance with this convention, FIG. 14A may be referred to as a top view of the charging handle body 120, FIG. 14B may be referred to as a right side view of the charging handle body 120, and FIG. 14C may be referred to as a rear view of the charging handle body 120. FIG. 14A through FIG. 14F may be referred to collectively as FIG. 14. Terms such as front view and right side view are used herein as a convenient method for differentiating between the views shown in FIG. 14. It will be appreciated that the elements shown in FIG. 14 may assume various orientations without deviating from the spirit and scope of this detailed description. Accordingly, the terms front view, right side view, top view, rear view, left side view, bottom view, and the like should not be interpreted to limit the scope of the invention recited in the attached claims. FIG. 14D may be referred to as a bottom view of the charging handle body 120, FIG. 14E may be referred to as a left side view of the charging handle body 120, and FIG. 14F may be referred to as a front view of the charging handle body 120.

Figure 15C:
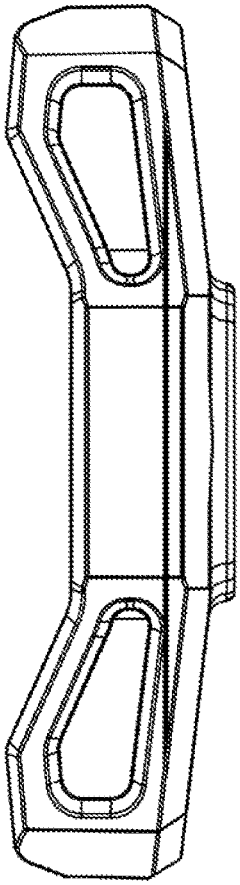
FIG. 15A through 15F are a group of top, bottom, front, rear, right side and left side views created using orthogonal projection. The views of FIG. 15A through FIG. 15F showing six sides of a grip member in accordance with the detailed description.
Figure 15A:
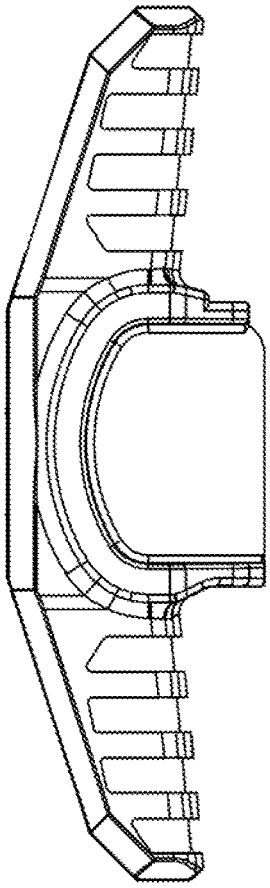
Figure 15B:
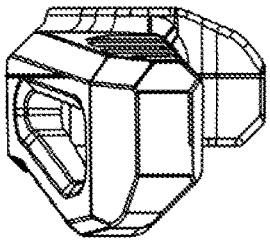
Figure 15D:
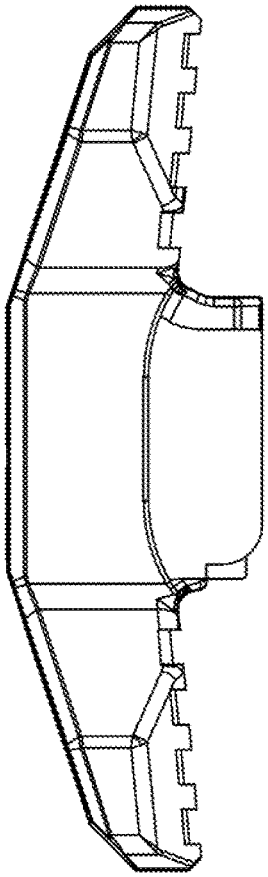
Figure 15F:
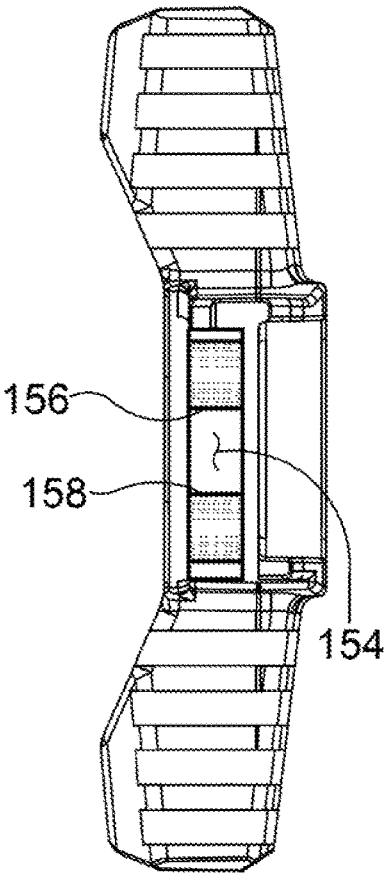
Figure 15E:
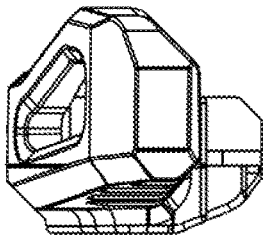

FIG. 15A through FIG. 15F are a collection of views showing six sides of a grip member 152. Engineer graphics textbooks generally refer to the process used to create views showing six sides of a three dimensional object as multiview projection or orthographic projection. It is customary to refer to multiview projections using terms such as front view, right side view, top view, rear view, left side view, and bottom view. In accordance with this convention, FIG. 15A may be referred to as a top view of the grip member 152, FIG. 15B may be referred to as a right side view of the grip member 152, and FIG. 15C may be referred to as a rear view of the grip member 152. FIG. 15A through FIG. 15F may be referred to collectively as FIG. 15. Terms such as front view and right side view are used herein as a convenient method for differentiating between the views shown in FIG. 15. It will be appreciated that the elements shown in FIG. 15 may assume various orientations without deviating from the spirit and scope of this detailed description. Accordingly, the terms front view, right side view, top view, rear view, left side view, bottom view, and the like should not be interpreted to limit the scope of the invention recited in the attached claims. FIG. 15D may be referred to as a bottom view of the grip member 152, FIG. 15E may be referred to as a left side view of the grip member 152, and FIG. 15F may be referred to as a front view of the grip member 152.

Figure 16A:
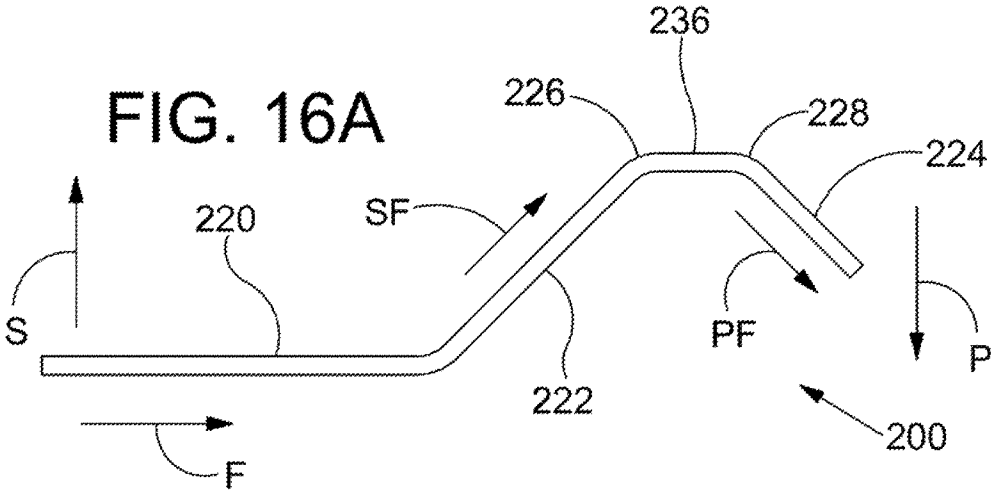
FIG. 16A through 16F are a group of top, bottom, front, rear, right side and left side views created using orthogonal projection. The views of FIG. 16A through FIG. 16F showing six sides of a latch member in accordance with the detailed description.
Figure 16B:
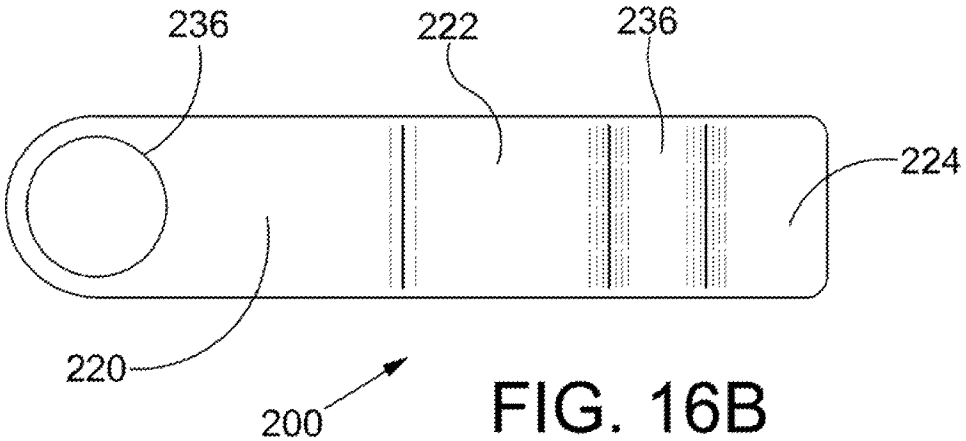
Figure 16C:
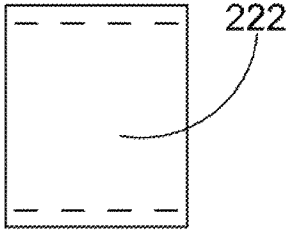
Figure 16F:
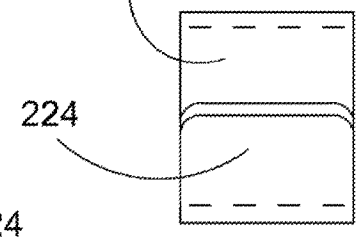
Figure 16D:
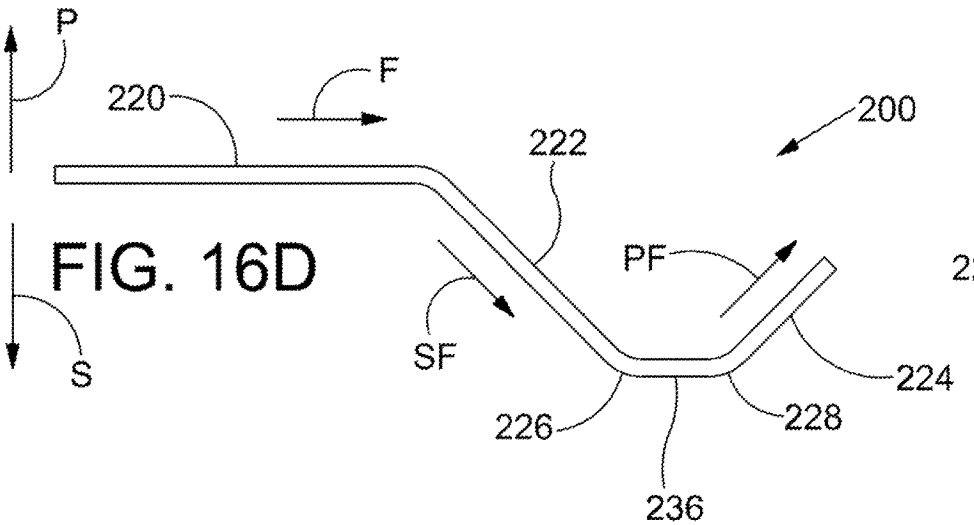
Figure 16E:
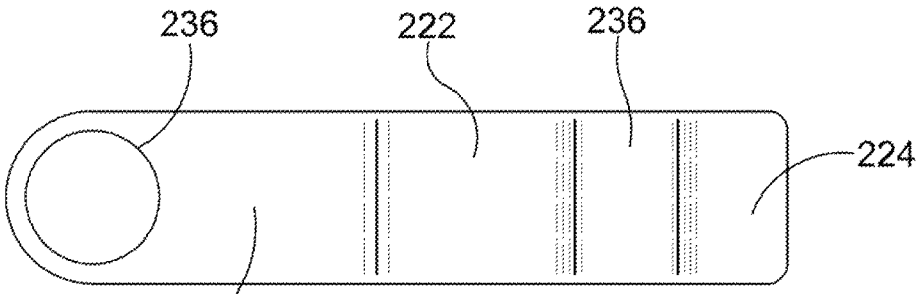

FIG. 16A through FIG. 16F are a collection of views showing six sides of a latch member 200. In the field of engineer graphics, the process used to create views showing six sides of a three dimensional object may be referred to as multiview projection or orthographic projection. It is customary to refer to multiview projections using terms such as front view, right side view, top view, rear view, left side view, and bottom view. In accordance with this convention, FIG. 16A may be referred to as a top view of the latch member 200, FIG. 16B may be referred to as a right side view of the latch member 200, and FIG. 16C may be referred to as a rear view of the latch member 200. FIG. 16A through FIG. 16F may be referred to collectively as FIG. 16. Terms such as front view and right side view are used herein as a convenient method for differentiating between the views shown in FIG. 16. It will be appreciated that the elements shown in FIG. 16 may assume various orientations without deviating from the spirit and scope of this detailed description. Accordingly, the terms front view, right side view, top view, rear view, left side view, bottom view, and the like should not be interpreted to limit the scope of the invention recited in the attached claims. FIG. 16D may be referred to as a bottom view of the latch member 200, FIG. 16E may be referred to as a left side view of the latch member 200, and FIG. 16F may be referred to as a front view of the latch member 200.

Figure 17A:
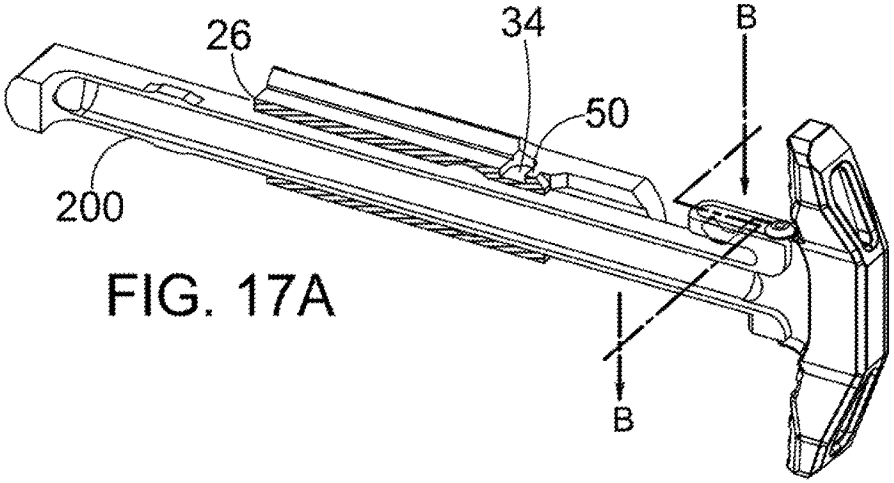
FIG. 17A is a perspective view of an assembly including a charging handle and a portion of the upper receiver shown in FIG. 5.
Figure 17B:
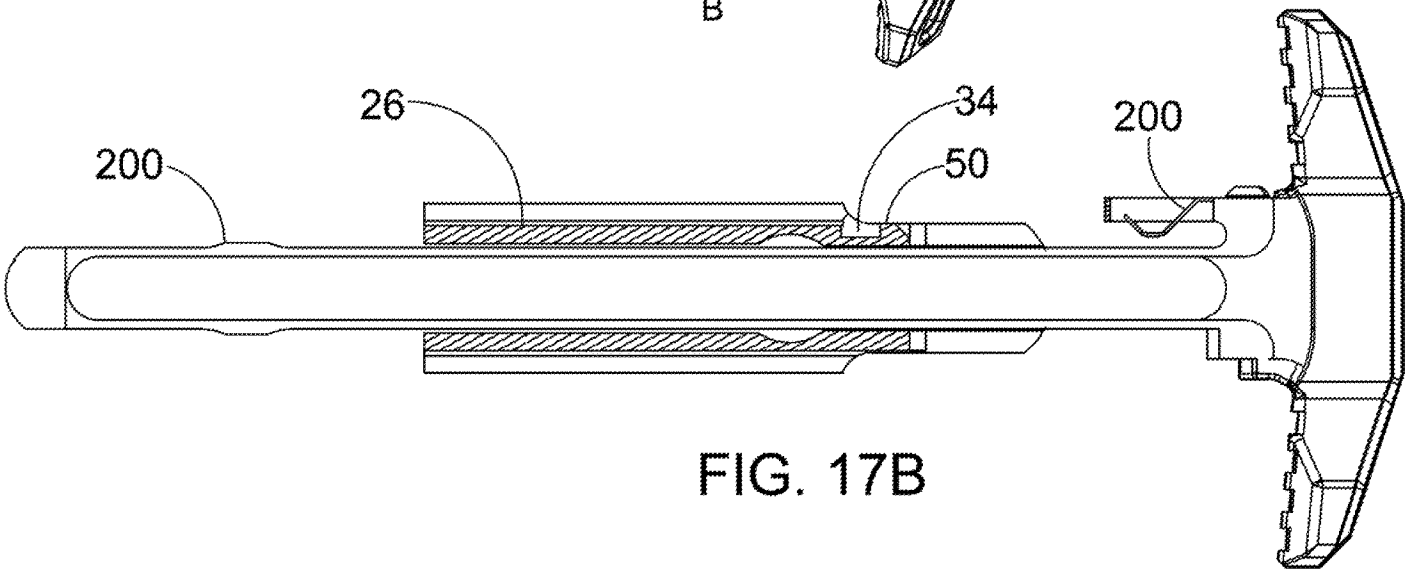
FIG. 17B is a plan view of the assembly shown in FIG. 17A. In the example embodiment of FIG. 17B, a strut portion of the charging handle has been sectioned along section line B-B shown in FIG. 17A.
Figure 18A:
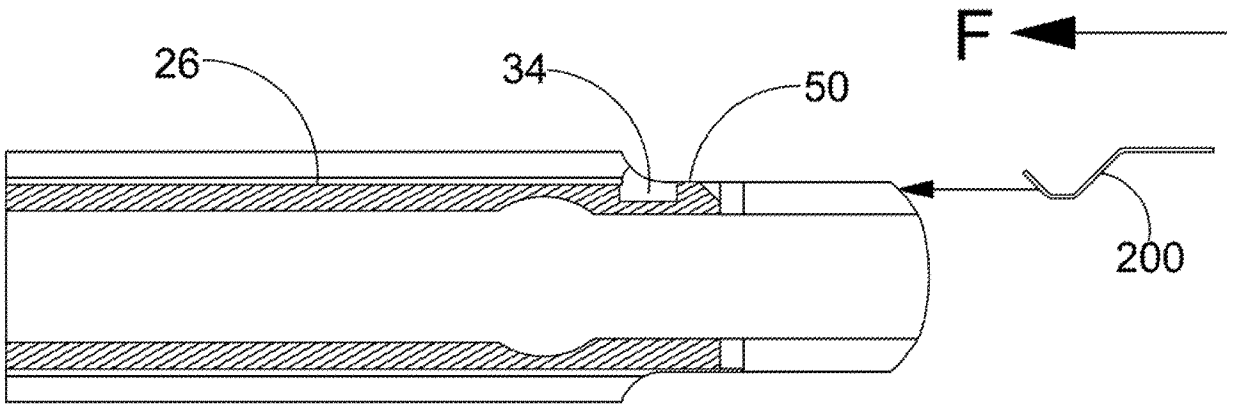
FIG. 18A is a plan view showing the latch member and a portion of the upper receiver wall shown in FIG. 17A.
Figure 18B:
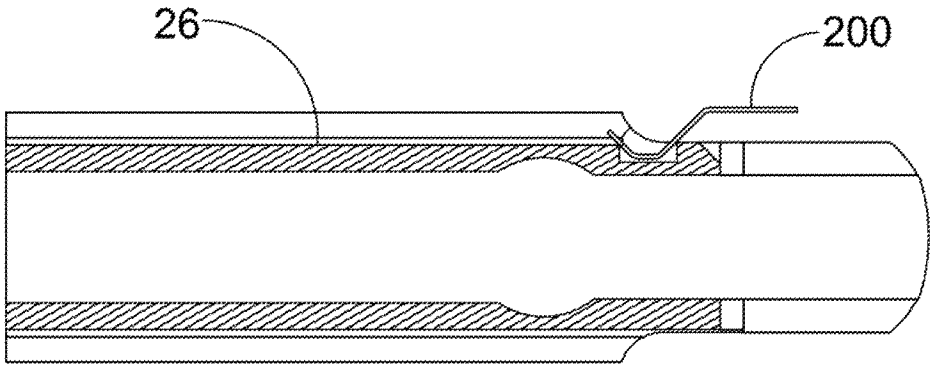
FIG. 18B is another plan view showing the latch member and a portion of the upper receiver wall shown in FIG. 18A. In the example embodiment of FIG. 18B, the foot portion of the latch member is received in a depression defined by the upper receiver wall.

FIG. 17A is a perspective view of an assembly including a charging handle and a portion of the upper receiver shown in FIG. 5. A section line B-B is shown in FIG. 17A. FIG. 17B is a plan view of the assembly shown in FIG. 17A. In the example embodiment of FIG. 17B, a strut portion of the charging handle has been sectioned along section line B-B (shown in FIG. 17A). FIG. 18A is a plan view showing the latch member 200 and a portion of the upper receiver wall 26 shown in FIG. 17A. FIG. 18A is another plan view showing the latch member 200 and a portion of the upper receiver wall 26 shown in FIG. 18A. In the example embodiment of FIG. 18B, the foot portion of the latch member 200 is received in a depression defined by the upper receiver wall 26.

Figure 19A:
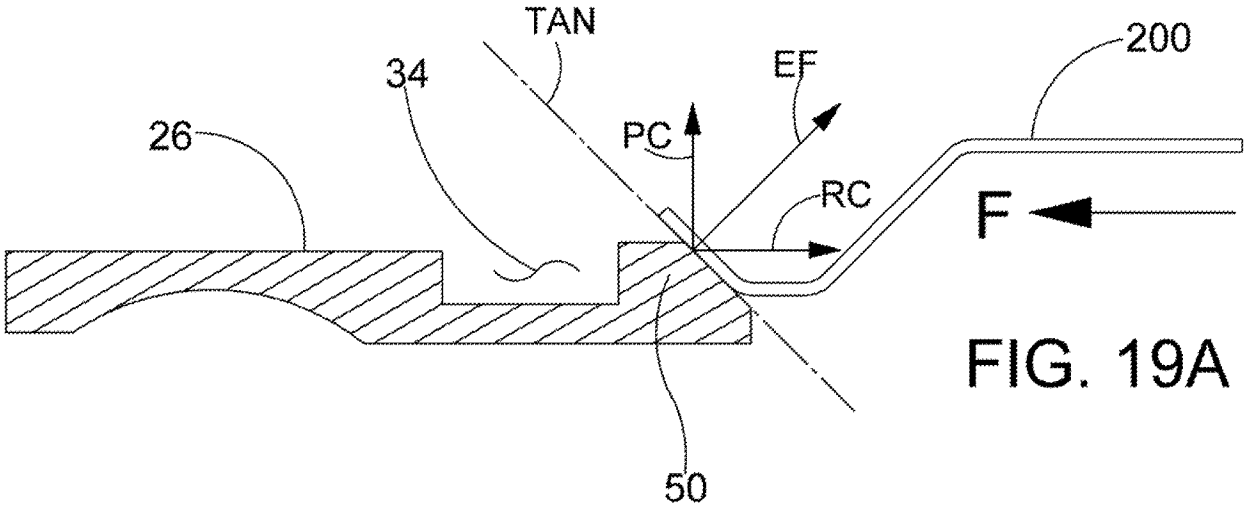
FIG. 19A is a stylized diagram showing the latch member and a portion of the upper receiver wall shown in FIGS. 17A through 18B.

FIG. 19A is a stylized diagram showing the latch member 200 and a portion of the upper receiver wall 26 shown in FIGS. 17A through 18B. FIG. 19A illustrates an example embodiment in which the second ramp portion of the latch member is contacting a leaf spring engaging portion 50 of the upper receiver wall at a point of tangency. A tangent line TAN is shown extending through the point of tangency in FIG. 19A. The second ramp portion of the latch member may contact the leaf spring engaging portion 50 of the upper receiver wall, for example, during translation of the charging handle in a forward direction F toward a fully inserted position. As shown in FIG. 19A, the leaf spring engaging portion 50 of the upper receiver wall acts on the second ramp portion with a engagement force EF. In some useful embodiments, the orientation of the second ramp portion relative to a charging handle translation path is such that the engagement force EF has a rearwardly directed component RC and a portwardly directed component PC and the portwardly directed component PC acts to deflect the latch member in a cantilevered fashion.

Figure 19B:
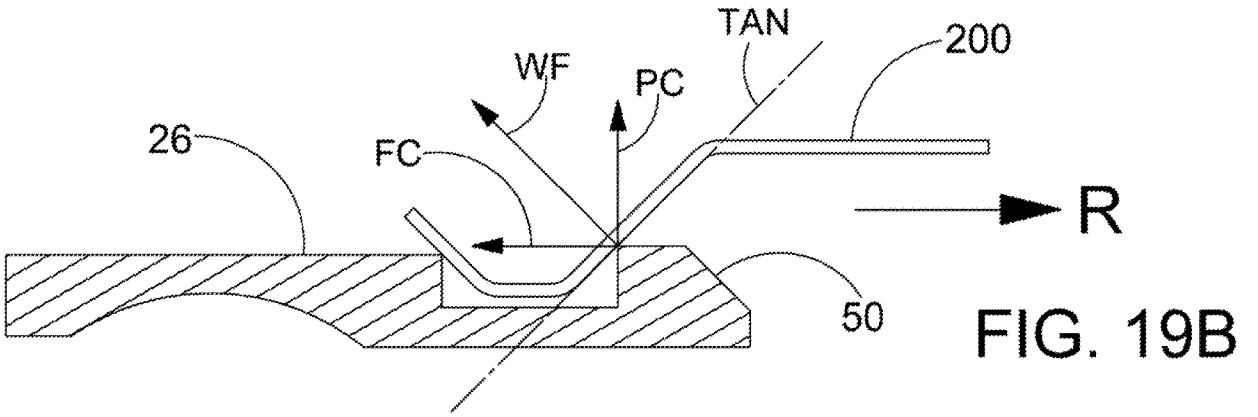
FIG. 19B is a stylized diagram showing the latch member and a portion of the upper receiver wall shown in FIGS. 17A through 18B.

FIG. 19B is a stylized diagram showing the latch member 200 and a portion of the upper receiver wall 26 shown in FIGS. 17A through 18B. FIG. 19B illustrates an example embodiment in which the foot portion of the latch member 200 is received in a depression 34 defined by the upper receiver wall 26. In the example embodiment of FIG. 19B, the first ramp portion of the latch member is contacting the leaf spring engaging portion 50 of the upper receiver wall at a point of tangency. A tangent line TAN is shown extending through the point of tangency in FIG. 19B. The first ramp portion of the latch member may contact the leaf spring engaging portion 50 of the upper receiver wall, for example, during translation of the charging handle in a rearward direction F away from a fully inserted position. As shown in FIG. 19B, the leaf spring engaging portion 50 of the upper receiver wall acts on the first ramp portion with a wall force WF. In some useful embodiments, the orientation of the first ramp portion relative to a charging handle translation path is such that the wall force WF has a forwardly directed component FC and a portwardly directed component PC and the portwardly directed component PC acts to deflect the latch member in a cantilevered fashion.

Figure 20:
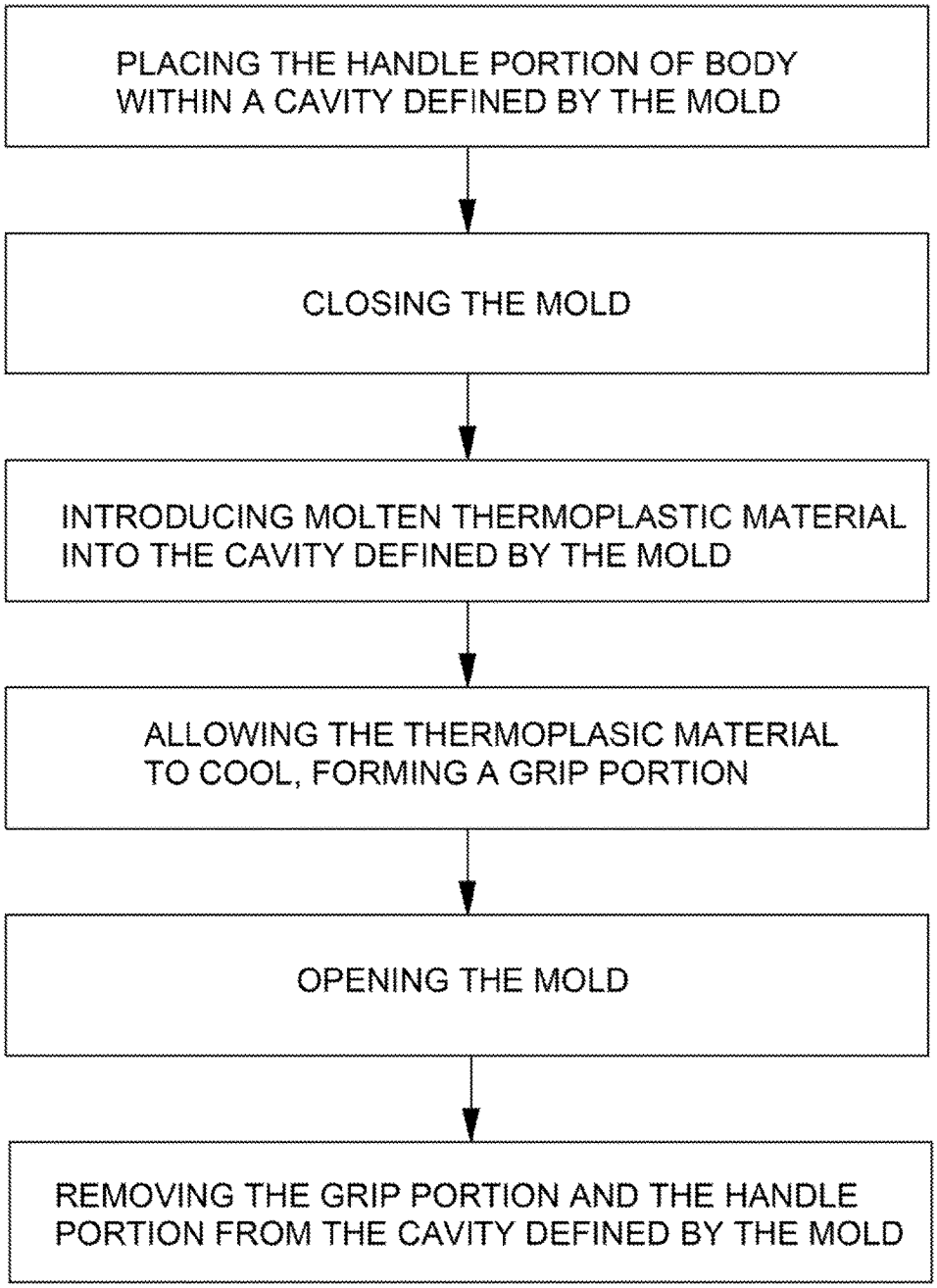
FIG. 20 is a flowchart illustrating an example method for manufacturing a charging handle in accordance with the detailed description.

FIG. 20 is a flowchart illustrating an example method for manufacturing a charging handle. An example method for manufacturing a charging handle may include providing a manufacturing handle body and placing at least the handle portion of the body within a cavity defined by a mold. Molten thermoplastic material may be injected into the cavity defined by the mold. The thermoplastic material may be allowed to cool forming a grip portion encasing at least part of the handle portion of the body. The grip portion and the handle portion may be removed from the cavity defined by the mold.

Figure 21A:
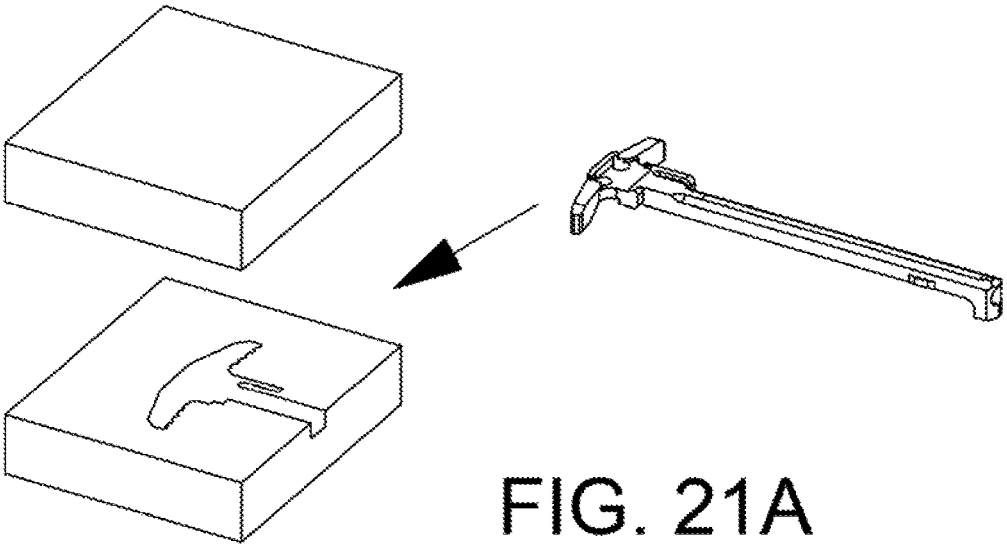
FIG. 21A-21D are a series of stylized perspective views illustrating an example method for manufacturing a charging handle in accordance with the detailed description.
Figure 21B:
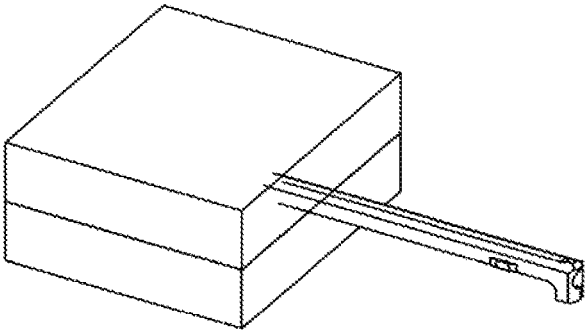
Figure 21C:
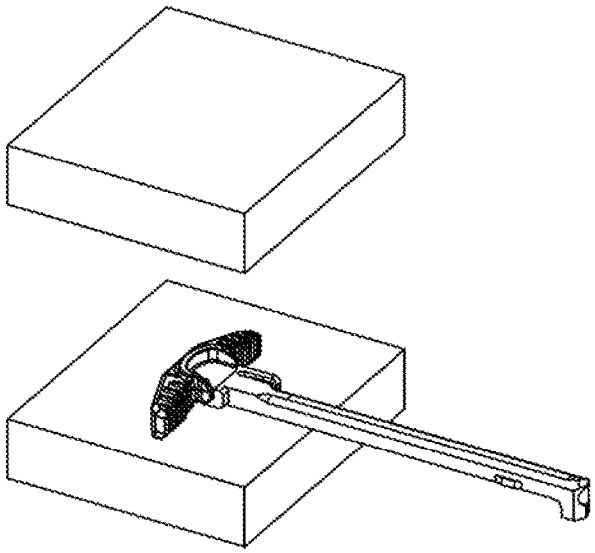
Figure 21D:
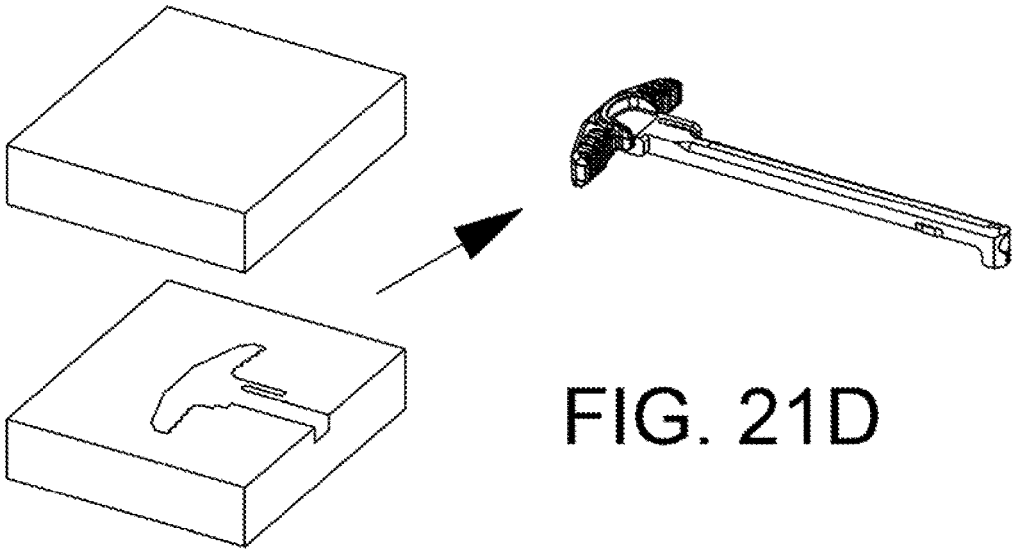

FIG. 21A-21D are a series of stylized perspective views illustrating an example method for manufacturing a charging handle. FIG. 21A shows a handle portion of a charging handle body being placed within a cavity defined by a mold. FIG. 21B shows the mold and the charging handle body after the mold has been closed. Molten thermoplastic material may be injected into the cavity defined by the mold. The thermoplastic material may be allowed to cool forming a grip portion encasing at least part of the handle portion of the body. FIG. 21C shows the mold, the charging handle body and the grip portion after the mold has been opened. FIG. 21D shows the handle portion of the body and the grip portion being removed from the cavity defined by the mold.

Referring, for example, to FIGS. 17A-19B and 4-6, a charging handle 100 in accordance with an example embodiment comprises a body 120 having a handle portion 122, a bolt engaging portion 126, a strut portion 138, and a shaft portion 124. In an embodiment, the shaft portion 124 extends forwardly from the handle portion 122 to the bolt engaging portion 126. The shaft portion 124 may be dimensioned to extend into a channel 30 defined by the inner surfaces of the upper receiver 22 of a rifle 20. In an embodiment, the bolt engaging portion 126 of the body 120 comprises a projection 128 configured and dimensioned to engage the bolt of the rifle 20 for pulling the bolt in the rearward direction as the charging handle 100 is pulled rearward from a fully inserted position to a more rearward position. The handle portion 122 of the body 120 may have a starboard arm 130 extending away from the shaft portion 124 in a starboard direction S and a port arm 132 extending away from the shaft portion 124 in a portward direction P. In an embodiment, the strut portion 138 extends away from the handle portion 122 in the forward direction F with the strut portion 138 being offset from the shaft portion 124 by an offset distance so that a slot 150 is defined between a starboard facing surface 146 of the strut portion 138 and a port facing surface 148 of the shaft portion 124. In an embodiment, the offset distance is selected so that a portion of the upper receiver wall 26 of the rifle 20 is received in the slot 150 when the charging handle 100 is in the fully inserted position. The strut portion 138 may define an aperture 140 communicating with the slot 150. In an embodiment, the charging handle 100 also includes a latch member 200 comprising a leaf spring. A rearward portion 220 of the latch member 200 may be fixed to the body 120 of the charging handle 100 and a forward portion of the latch member 200 may be disposed in the aperture 140 defined by the strut portion 138. In an embodiment, the latch member 200 includes a foot portion 236 receivable in a depression 34 defined by the upper receiver wall 26 when the charging handle 100 is in the fully inserted position and the leaf spring is configured to deflect allowing the foot portion 236 to exit the depression 34 when the charging handle 100 is pulled rearward from the fully inserted position to a more rearward position.

Referring to FIGS. 8-10 and 15A-15F, in embodiments, the charging handle 100 comprises a grip member 150 disposed about the handle portion 122 of the body 120 so that the grip member 150 encapsulates the handle portion 122 and the handle portion 422 is disposed inside the grip member 150. In an embodiment, the grip member 150 comprises a first bridging portion 156 extending in the upward and downward directions through a first hole 134 defined by the handle portion 122 and a second bridging portion 158 extending in the upward direction through a second hole 136 defined by the handle portion 122 to mechanically interlock the grip member 150 and the handle portion 122 to one another. The grip member 150 may comprise a thermoplastic material overmolded on the handle portion 122 of the body 120.

Referring to 16A-16F, 18A-18B, and 19A-19B, in embodiments, the latch member 200 comprises the rearward portion 220, a first ramp portion 222 disposed forward of the rearward portion 220, a foot portion 236 disposed forward of the first ramp portion 222, and a second ramp portion 224 disposed forward of the foot portion 236. In an embodiment, the charging handle 100 is configured so that the second ramp portion 224 of the leaf spring contacts and a leaf spring engaging portion 50 of the upper receiver wall 26 during forward translation of the charging handle 100 toward a fully inserted position. In an embodiment, the leaf spring engaging portion 50 of the upper receiver wall 26 applies an engagement force EF to the second ramp portion 224 during forward translation of the charging handle 100 toward the forwardmost position. In an embodiment, the orientation of the second ramp portion 224 relative to a longitudinal axis of the charging handle 100 is such that the engagement force EF has a rearwardly directed component RC and a portwardly directed component PC and the portwardly directed component PC acts to deflect the leaf spring in a cantilevered fashion.

Referring, for example, to FIGS. 7A-10, a charging handle 100 in accordance with an example embodiment comprises a body 120 having a handle portion 122, a bolt engaging portion 126, a strut portion 138, and a shaft portion 124. In an embodiment, the shaft portion 124 extends forwardly from the handle portion 122 to the bolt engaging portion 126. The shaft portion 124 may be dimensioned to extend into a channel 30 defined by the inner surfaces of the upper receiver of a rifle 20. In an embodiment, the bolt engaging portion 126 of the body 120 comprises a projection 128 configured and dimensioned to engage the bolt of the rifle 20 for pulling the bolt in the rearward direction as the charging handle 100 is pulled rearward from a fully inserted position to a more rearward position. The handle portion 122 of the body 120 may have a starboard arm 130 extending away from the shaft portion 124 in a starboard direction S and a port arm 132 extending away from the shaft portion 124 in a portward direction P. In an embodiment, the strut portion 138 extends away from the handle portion 122 in the forward direction F with the strut portion 138 being offset from the shaft portion 124 by an offset distance so that a slot 150 is defined between a starboard facing surface 146 of the strut portion 138 and a port facing surface 148 of the shaft portion 124. In an embodiment, the offset distance is selected so that a portion of the upper receiver wall 26 of the rifle 20 is received in the slot 150 when the charging handle 100 is in the fully inserted position. In an embodiment, the charging handle 100 comprises a grip member 150 disposed about the handle portion 122 of the body 120 so that the grip member 150 encapsulates the handle portion 122 and the handle portion 122 is disposed inside the grip member 150. In an embodiment, the grip member 150 comprises a first bridging portion 156 extending in the upward and downward directions through a first hole 134 defined by the handle portion 122 and a second bridging portion 158 extending in the upward direction through a second hole 136 defined by the handle portion 122 to mechanically interlock the grip member 150 and the handle portion 122 to one another. The grip member 150 may comprise a thermoplastic material overmolded on the handle portion 122 of the body 120. In an embodiment, the grip member 150 comprises a plurality of grooves 160 and a plurality of ribs 162, each groove 160 having a groove base surface extending between a pair of ribs 162 and each rib 162 extending forwardly beyond one or more adjacent groove base surfaces 164.

A feature and benefit of embodiments is a charging handle including a plurality of grooves and ribs that reduce the likelihood that the users hand will slip off the charging handle even in adverse (e.g., battlefield) conditions. At the same time, abrasion to the user's hand is reduced by providing grip member comprising a relatively soft material. In an embodiment, the grip member comprises a first material having a first hardness, the charging handle body comprises a second material having a second hardness, and the second hardness is greater than the first hardness. In an embodiment, the grip member comprises a polymeric material and the charging handle body comprises a metallic material. In an embodiment, the grip member comprises a thermoplastic material and the charging handle body comprises a metallic material. In an embodiment, the grip member comprises a polyimide material and the charging handle body comprises aluminum. In an embodiment, the grip member comprises nylon and the charging handle body comprises aluminum.

The following United States patents are hereby incorporated by reference herein: U.S. Pat. No. 3,225,653, U.S. Pat. No. 6,311,603, U.S. Pat. No. 7,231,861, U.S. Pat. No. 7,240,600, U.S. Pat. No. 7,588,023, U.S. Pat. No. 7,707,921, U.S. Pat. No. 7,798,045, U.S. Pat. No. 7,832,322, U.S. Pat. No. 7,861,635, U.S. Pat. No. 7,900,546, U.S. Pat. No. 8,104,393, U.S. Pat. No. 8,261,649, U.S. Pat. No. 8,336,436, U.S. Pat. No. 8,356,537, U.S. Pat. No. 8,381,628, U.S. Pat. No. 8,567,301, U.S. Pat. No. 8,756,847, U.S. Pat. No. 8,800,422, U.S. Pat. No. 8,820,210, U.S. Pat. No. 8,863,632, U.S. Pat. No. 8,887,612, U.S. Pat. No. 8,950,097, U.S. Pat. No. 8,960,066, U.S. Pat. No. 9,175,913, U.S. Pat. No. 9,222,738, U.S. Pat. No. 9,366,489, U.S. Pat. No. 9,377,258, U.S. Pat. No. 9,423,195, and U.S. Pat. No. 9,435,593.

The above references in all sections of this application are herein incorporated by references in their entirety for all purposes. Components illustrated in such patents may be utilized with embodiments herein. Incorporation by reference is discussed, for example, in MPEP section 2163.07(B).

All of the feature's disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A charging handle for use with a gas operated rifle, the rifle comprising an upper receiver and a bolt slidingly disposed therein, the upper receiver defining an inner channel and a latch member catch portion, the charging handle comprising a body, a grip portion, and a latch member, the body having a handle portion, a bolt engaging portion, and a shaft portion, the shaft portion extending in a forward direction from the handle portion to the bolt engaging portion and in a rearward direction from the bolt engaging portion to the handle portion, the shaft portion being configured and dimensioned to extend into the channel defined by the inner surfaces of the upper receiver, the bolt engaging portion comprising a projection configured and dimensioned to engage the bolt of the rifle for pulling the bolt in the rearward direction, the projection extending in a downward direction beyond a lower surface of the shaft portion;

the handle portion having a starboard arm extending away from the shaft portion in a starboard direction and a port arm extending away from the shaft portion in a portward direction, the handle portion defining a first hole and a second hole, the first hole and the second hole both being positioned between the starboard arm and the port arm;

a strut portion extending away from the handle portion in the forward direction, the strut portion defining an aperture, the aperture having a first opening extending through a starboard facing surface of the strut portion and a second opening extending through a port facing surface of the strut portion, the strut portion being offset from the shaft portion by an offset distance so that a slot is defined between the starboard surface of the strut portion and a port facing surface of the shaft portion, the slot having a width corresponding to the offset distance, the slot being dimensioned to receive a portion of the upper receiver wall which extends into the slot when the charging handle is in a fully inserted position, the slot fluidly communicating with the aperture;

the grip member disposed about the handle portion of the body so that the grip member encapsulates the handle portion and the handle portion is disposed inside the grip member, the grip member comprising a first bridging portion extending in the upward and downward directions through the first hole and a second bridging portion extending in the upward direction through the second hole to mechanically interlock the grip member and the handle portion to one another; and the grip member comprising a plurality of grooves and a plurality of ribs, each groove having a groove base surface extending between a pair of ribs, each rib extending forwardly beyond one or more adjacent groove base surfaces.

2. The charging handle of claim 1, wherein the grip member comprises a thermoplastic material overmolded on the handle portion of the body.

3. The charging handle of claim 1 further including a latch member comprising a leaf spring, a rearward portion of the latch member being fixed to the body of the charging handle and a forward portion of the latch member being disposed in the aperture defined by the strut portion, the latch member including a foot portion receivable in the depression defined by the upper receiver wall when the charging handle is in the fully inserted position and the leaf spring configured to deflect allowing the foot portion to exit the depression when the charging handle is pulled rearward from the fully inserted position to a more rearward position.

4. The charging handle of claim 3, wherein the latch member comprises the rearward portion, a first ramp portion disposed forward of the rearward portion, the foot portion disposed forward of the first ramp portion, and a second ramp portion disposed forward of the foot portion.

5. The charging handle of claim 4, wherein the charging handle is configured so that the second ramp portion contacts a leaf spring engaging portion of the upper receiver wall during forward translation of the charging handle toward the fully inserted position; the leaf spring engaging portion of the upper receiver wall applies a wall force to the second ramp portion during forward translation of the charging handle toward the forwardmost position; and the orientation of the second ramp portion relative to a longitudinal axis of the charging handle is such that the wall force has a rearwardly directed component and a portwardly directed component and the portwardly directed component acts to deflect the leaf spring in a cantilevered fashion.

6. The charging handle of claim 4, wherein the latch member comprises a first bend disposed between the rearward portion and the first ramp portion, the first bend being configured such that the first ramp portion extends away from the rearward portion in a starboard, forward direction.

7. The charging handle of claim 6, wherein the latch member comprises a second bend disposed between the first ramp portion and the foot portion, the second bend being configured such that the foot portion extends away from the first ramp portion in a forward direction.

8. The charging handle of claim 7, wherein the latch member comprises a third bend disposed between the foot portion and the second ramp portion, the third bend being configured such that the second ramp portion extends away from the foot portion in a portward, forward direction.

9. The charging handle of claim 1 in combination with the gas operated rifle.

* * * * *